US006756351B2

(12) United States Patent
Weuthen

(10) Patent No.: US 6,756,351 B2
(45) Date of Patent: Jun. 29, 2004

(54) DETERGENTS AND CLEANING AGENTS

(75) Inventor: Manfred Weuthen, Langenfeld (DE)

(73) Assignee: Cognis Deutschland GmbH & Co. KG, Duesseldorf (DE)

( * ) Notice: Subject to any disclaimer, the term of this patent is extended or adjusted under 35 U.S.C. 154(b) by 0 days.

(21) Appl. No.: 10/257,853

(22) PCT Filed: Apr. 7, 2001

(86) PCT No.: PCT/EP01/04033

§ 371 (c)(1),
(2), (4) Date: Oct. 17, 2002

(87) PCT Pub. No.: WO01/79401

PCT Pub. Date: Oct. 25, 2001

(65) Prior Publication Data

US 2003/0119695 A1 Jun. 26, 2003

(30) Foreign Application Priority Data

Apr. 18, 2000 (DE) ..... 100 19 344

(51) Int. Cl.[7] ..... C11D 1/72; C11D 17/04; C11D 3/37

(52) U.S. Cl. ..... 510/296; 510/297; 510/356; 510/360; 510/421; 510/422; 510/439; 510/475; 510/505; 510/506

(58) Field of Search ..... 510/296, 356, 510/297, 360, 421, 422, 439, 475, 505, 506

(56) References Cited

U.S. PATENT DOCUMENTS

| | | | | |
|---|---|---|---|---|
| 3,277,009 | A | | 10/1966 | Freifeld et al. |
| 3,966,629 | A | | 6/1976 | Dumbrell |
| 4,062,647 | A | | 12/1977 | Storm et al. |
| 4,199,465 | A | * | 4/1980 | Rodriguez ..... 252/91 |
| 4,524,009 | A | | 6/1985 | Valenty |
| 4,639,325 | A | | 1/1987 | Valenty et al. |
| 4,664,839 | A | | 5/1987 | Rieck |
| 4,737,306 | A | | 4/1988 | Wichelhaus et al. |
| 4,816,553 | A | | 3/1989 | Baur et al. |
| 4,898,621 | A | * | 2/1990 | Pruehs et al. ..... 134/25.2 |
| 4,985,553 | A | | 1/1991 | Fuertes et al. |
| 5,002,695 | A | | 3/1991 | Schulz et al. |
| 5,318,733 | A | | 6/1994 | Carduck et al. |
| 5,356,607 | A | | 10/1994 | Just |
| 5,374,716 | A | | 12/1994 | Biermann ey al. |
| 5,431,780 | A | | 7/1995 | Raehse et al. |
| 5,494,488 | A | | 2/1996 | Arnoldi et al. |
| 5,501,814 | A | | 3/1996 | Engelskirchen et al. |
| 5,536,430 | A | | 7/1996 | Fues et al. |
| 5,541,316 | A | | 7/1996 | Engelskirchen et al. |
| 5,576,425 | A | | 11/1996 | Hill et al. |
| 5,580,941 | A | | 12/1996 | Krause et al. |
| 5,637,560 | A | | 6/1997 | Raehse et al. |
| 5,780,420 | A | | 7/1998 | Breuer et al. |
| 5,821,360 | A | | 10/1998 | Engelskirchen et al. |
| 5,830,956 | A | | 11/1998 | Stockhausen et al. |
| 5,877,134 | A | * | 3/1999 | Scheper et al. ..... 510/220 |
| 5,959,101 | A | | 9/1999 | Engelskirchen et al. |
| 6,075,001 | A | | 6/2000 | Wilde |
| 6,153,576 | A | | 11/2000 | Blum et al. |
| 6,187,055 | B1 | | 2/2001 | Kottwitz et al. |
| 6,200,946 | B1 | | 3/2001 | Blum et al. |
| 6,506,720 | B1 | | 1/2003 | Blasey et al. |
| 2002/0107165 | A1 | * | 8/2002 | Weuthen et al. ..... 510/421 |

FOREIGN PATENT DOCUMENTS

| | | |
|---|---|---|
| CH | 347930 | 9/1960 |
| DE | 2 334 899 | 1/1974 |
| DE | 25 53 900 | 6/1977 |
| DE | 35 26 405 | 2/1987 |
| DE | 36 16 842 | 11/1989 |
| DE | 40 30 688 | 4/1992 |
| DE | 41 15 286 | 11/1992 |
| DE | 42 04 035 | 8/1993 |
| DE | 42 04 090 | 8/1993 |
| DE | 42 06 050 | 9/1993 |
| DE | 42 06 495 | 9/1993 |
| DE | 42 06 521 | 9/1993 |
| DE | 42 08 773 | 9/1993 |
| DE | 42 09 432 | 9/1993 |
| DE | 42 21 381 | 2/1994 |
| DE | 42 34 376 | 4/1994 |
| DE | 43 00 772 | 7/1994 |

(List continued on next page.)

OTHER PUBLICATIONS

R.C. MacKenzie and B.D. Mitchell, "Differential Thermal Analysis, A Review", THE ANALYST, vol. 87, (Jun. 1962), pp. 420–434.

J. Pharm. Sci., vol. 61, (1972) (reciting entire book–not enclosed).

"Tablettensprengmittel", Römpp Chemilexikon, 9th Ed., vol. 6, (1992), p.4440.

Voigt, "Lehrbuch der pharmazeutischen Technologie" (Textbook of Pharmaceutical Technology), 6th Ed., (1987), pp. 182–184.

*Primary Examiner*—Mark Kopec
*Assistant Examiner*—Brian P. Mruk
(74) *Attorney, Agent, or Firm*—John E. Drach

(57) ABSTRACT

Cleaning packets containing laundry detergents are comprised of a water-soluble container or a water-insoluble container comprising a compound of the formula (I)

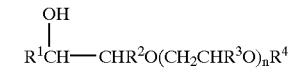

(I)

wherein $R^1$ is a linear or branched alkyl radical having from 2 to 18 carbon atoms, $R^2$ is hydrogen or a linear or branched alkyl radical having from 2 to 18 carbon atoms, $R^3$ is hydrogen or methyl, $R^4$ is a linear or branched, alkyl and/or alkenyl radical having from 1 to 22 carbon atoms and n is a number from 1 to 50, with the proviso that the sum of the carbon atoms in the radicals $R^1$ and $R^2$ is at least 6. The cleaning packets exhibit improved washing performance.

7 Claims, No Drawings

FOREIGN PATENT DOCUMENTS

| | | | | |
|---|---|---|---|---|
| DE | 43 03 320 | | 8/1994 | |
| DE | 44 00 024 | | 7/1995 | |
| DE | 44 16 438 | | 11/1995 | |
| DE | 44 17 734 | | 11/1995 | |
| DE | 44 43 177 | | 6/1996 | |
| DE | 195 29 905 | | 2/1997 | |
| DE | 195 36 082 | | 4/1997 | |
| DE | 196 00 018 | | 7/1997 | |
| DE | 196 05 688 | | 8/1997 | |
| DE | 196 13 103 | | 10/1997 | |
| DE | 196 20 411 | | 10/1997 | |
| DE | 196 16 693 | | 11/1997 | |
| DE | 196 16 767 | | 11/1997 | |
| DE | 196 16 770 | | 11/1997 | |
| DE | 196 16 796 | | 11/1997 | |
| DE | 196 20 267 | | 11/1997 | |
| DE | 197 09 991 | | 9/1998 | |
| DE | 197 10 254 | | 9/1998 | |
| DE | 199 31 399 | | 1/2001 | |
| DE | 19931399 | * | 1/2001 | ..... C11D/17/00 |
| DE | 10017191 | * | 10/2001 | ..... C11D/1/83 |
| EP | 0 026 529 | | 4/1981 | |
| EP | 0 028 432 | | 5/1981 | |
| EP | 0 150 930 | | 8/1985 | |
| EP | 0 164 514 | | 12/1985 | |
| EP | 0 232 202 | | 8/1987 | |
| EP | 0 272 030 | | 6/1988 | |
| EP | 0 280 223 | | 8/1988 | |
| EP | 0 301 298 | | 2/1989 | |
| EP | 0 309 931 | | 4/1989 | |
| EP | 0 392 592 | | 10/1990 | |
| EP | 0 427 349 | | 5/1991 | |
| EP | 0 443 651 | | 8/1991 | |
| EP | 0 446 982 | | 9/1991 | |
| EP | 0 453 003 | | 10/1991 | |
| EP | 0 458 397 | | 11/1991 | |
| EP | 0 458 398 | | 11/1991 | |
| EP | 0 472 042 | | 2/1992 | |
| EP | 0 486 592 | | 5/1992 | |
| EP | 0 496 510 | | 7/1992 | |
| EP | 0 525 239 | | 2/1993 | |
| EP | 0 542 496 | | 5/1993 | |
| EP | 0 544 490 | | 6/1993 | |
| EP | 0 544 519 | | 6/1993 | |
| EP | 0 549 271 | | 6/1993 | |
| EP | 0 549 272 | | 6/1993 | |
| EP | 0 693 049 | | 1/1996 | |
| EP | 0 693 550 | | 1/1996 | |
| EP | 0 703 292 | | 3/1996 | |
| EP | 1167499 | * | 6/2001 | ..... C11D/1/72 |
| GB | 833361 | | 4/1960 | |
| GB | 1 400 898 | | 7/1975 | |
| GB | 94 19 091 | | 8/1988 | |
| JP | 93/339896 | | 12/1993 | |
| WO | WO 90/03977 | | 4/1990 | |
| WO | WO 91/08171 | | 6/1991 | |
| WO | WO 92/18542 | | 10/1992 | |
| WO | WO 93/02176 | | 2/1993 | |
| WO | WO 93/08251 | | 4/1993 | |
| WO | WO 93/16110 | | 8/1993 | |
| WO | WO 94/09111 | | 4/1994 | |
| WO | WO 94/22800 | | 10/1994 | |
| WO | WO 94/27970 | | 12/1994 | |
| WO | WO 94/28030 | | 12/1994 | |
| WO | WO 94/28102 | | 12/1994 | |
| WO | WO 94/28103 | | 12/1994 | |
| WO | WO 95/00626 | | 1/1995 | |
| WO | WO 95/07303 | | 3/1995 | |
| WO | WO 95/12619 | | 5/1995 | |
| WO | WO 95/14075 | | 5/1995 | |
| WO | WO 95/14759 | | 6/1995 | |
| WO | WO 95/17498 | | 6/1995 | |
| WO | WO 95/20608 | | 8/1995 | |
| WO | WO 95/27775 | | 10/1995 | |
| WO | WO 98/12299 | | 3/1998 | |
| WO | WO 98/40462 | | 9/1998 | |
| WO | WO 98/40463 | | 9/1998 | |
| WO | WO 98/55583 | | 12/1998 | |
| WO | WO 98/55590 | | 12/1998 | |
| WO | WO 01/79401 | * | 10/2001 | ..... C11D/1/72 |

* cited by examiner

DETERGENTS AND CLEANING AGENTS

BACKGROUND OF THE INVENTION

1. Field of the Invention

The invention is in the field of detergents and cleaning agents in the form of sachets and relates to novel preparations with a content of special nonionic surfactants.

2. Prior Art

For a long time detergents or constituents of detergents have been added to the wash liquor in small sacks (sometimes also referred to as bags), where the amount of the detergent or washing auxiliary is in many cases measured such that it corresponds to the amount required for one wash cycle. As well as simple dosing, a further advantage consists in the fact that contact between the detergent ingredients and the skin is avoided. Small sacks which contain two or more chambers for different detergent or washing auxiliary constituents are also often used. The latter variants are chosen in most cases when it is desired to combine detergent constituents which are incompatible with one another in one portion pack. This means that the storage stability can in many cases be decisively improved and in some cases be achieved in the first place. A further advantage for the user is that burdensome dosing is dispensed with. The small sack and the interaction between different detergent ingredients with water results in delayed release of the ingredients. However, it is observed here that the dissolution rate, especially in cold water, is in many cases inadequate.

The object of the present invention was therefore to provide novel detergents and cleaning agents in the form of sachets which are free from the disadvantages described and, in particular, to improve the detergent ingredients such that their release is accelerated.

DESCRIPTION OF THE INVENTION

The invention provides detergents and cleaning agents in the form of sachets which are characterized in that they comprise surface-active compounds of the hydroxy mixed ether type.

Surprisingly, it has been found that the use of surfactants of the hydroxy mixed ether type leads, irrespective of the material of the sachets, to a significant improvement in the dissolution rate and the washing performance. In this connection, the hydroxy mixed ethers have also proven to be, even at low concentrations, hydrotropes and gel breakers, which also makes it possible to co-use those surfactants which alone rapidly form gel phases and are thus only insufficiently soluble.

Hydroxy Mixed Ethers

Hydroxy mixed ethers (HME) are known nonionic surfactants with asymmetrical ether structure and polyalkylene glycol moieties which are obtained for example, by subjecting olefin epoxides with fatty alcohol polyglycol ethers to a ring-opening reaction. Corresponding products and the use thereof in the field of hard surface cleaning is, for example, the subject-matter of European patent specification EP 0693049 B1, and of international patent application WO 94/22800 (Olin), and the specifications cited therein. Typically, following hydroxy mixed ethers of the general formula (I)

$$R^1\overset{\overset{\displaystyle OH}{|}}{C}H-CHR^2O(CH_2CHR^3O)_nR^4 \qquad (I)$$

in which $R^1$ is a linear or branched alkyl radical having 2 to 18, preferably 10 to 16, carbon atoms, $R^2$ is hydrogen or a linear or branched alkyl radical having 2 to 18 carbon atoms, $R^3$ is hydrogen or methyl, $R^4$ is a linear or branched, alkyl and/or alkenyl radical having 1 to 22, preferably 8 to 18, carbon atoms and n is numbers from 1 to 50, preferably 2 to 25 and in particular 5 to 15, with the proviso that the sum of the carbon atoms in the radicals $R^1$ and $R^2$ is at least 6 and preferably 12 to 18. As is clear from the formula, the HME ring-opening products both of internal olefins ($R^2$ does not equal hydrogen) or terminal olefins ($R^2$ equals hydrogen), the latter being preferred with regard to the easier preparation and the more advantageous performance properties. Likewise, the polar moiety of the molecule may be a polyethylene or a polypropylene chain; likewise suitable are mixed chains of PE and PP units, whether in random distribution or block distribution. Typical examples are ring-opening products of 1,2-hexene epoxide, 2,3-hexene epoxide, 1,2-octene epoxide, 2,3-octene epoxide, 3,4-octene epoxide, 1,2-decene epoxide, 2,3-decene epoxide, 3,4-decene epoxide, 4,5-decene epoxide, 1,2-dodecene epoxide, 2,3-dodecene epoxide, 3,4-dodecene epoxide, 4,5-dodecene epoxide, 5,6-dodecene epoxide, 1,2-tetradecene epoxide, 2,3-tetradecene epoxide, 3,4-tetradecene epoxide, 4,5-tetradecene epoxide, 5,6-tetradecene epoxide, 6,7-tetradecene epoxide, 1,2-hexadecene epoxide, 2,3-hexadecene epoxide, 3,4-hexadecene epoxide, 4,5-hexadecene epoxide, 5,6-hexadecene epoxide, 6,7-hexadecene epoxide, 7,8-hexadecene epoxide, 1,2-octadecene epoxide, 2,3-octadecene epoxide, 3,4-octadecene epoxide, 4,5-octadecene epoxide, 5,6-octadecene epoxide, 6,7-octadecene epoxide, 7,8-octadecene epoxide and 8,9-octadecene epoxide, and mixtures thereof with addition products of, on average, 1 to 50, preferably 2 to 25 and in particular 5 to 15, mol of ethylene oxide and/or 1 to 10, preferably 2 to 8 and in particular 3 to 5, mol of propylene oxide onto saturated and/or unsaturated primary alcohols having 6 to 22, preferably 12 to 18, carbon atoms, such as, for example, caproic alcohol, caprylic alcohol, 2-ethylhexyl alcohol, capric alcohol, lauryl alcohol, isotridecyl alcohol, myristyl alcohol, cetyl alcohol, palmoleyl alcohol, stearyl alcohol, isostearyl alcohol, oleyl alcohol, elaidyl alcohol, petroselinyl alcohol, linolyl alcohol, linolenyl alcohol, elaeostearyl alcohol, arachyl alcohol, gadoleyl alcohol, behenyl alcohol, erucyl alcohol and brassidyl alcohol, and technical-grade mixtures thereof. The sachets usually comprise the hydroxy mixed ethers in amounts of from 0.2 to 20% by weight, preferably 02, to 10 and in particular 0.5 to 5% by weight, where, with regard to the dissolution rate, it has proven particularly advantageous to use the HME in the form of granulates. The incorporation of the hydroxy mixed ethers can, for example, also be carried out by spraying the surfactants onto a ready detergent premix.

Sachets

The materials of which the sachets for the detergents or the washing auxiliaries or detergent constituents exist are either insoluble in water, where "water-insoluble" is also to be understood as meaning "not swellable in water" or "not dispersible in water" or "not emulsifiable in water", or are soluble in water. In the case of the use of water-insoluble materials, in order that the ingredients can nevertheless be dissolved or dispersed in the water, the water-insoluble materials must either be pervious to water or the sachets made of water-impervious, water-insoluble materials must open in water so that the sachet ingredients come into contact with the water. The water perviousness can be achieved, for example, by perforating or slitting the sachet material, or by using porous materials, for example nonwovens prepared from water-insoluble fibers, or substances such as knits or wovens. With the use of such materials, it is important that a thorough flowing-through of the sachet with the water is possible. If, by contrast, water-impervious, water-insoluble materials are used, it is important that the small sacks prepared therefrom open upon contact with water or after a certain residence time in the water or as a certain water temperature is reached, thereby allowing the contents to come into contact with the water. This can be achieved, for example, by sealing by means of a water-soluble or water-sensitive adhesive, by sealing the bag with a seal seam which opens upon slight mechanical stress, by sealing with water-sensitive sewing thread or by using an adhesive which loses its adhesive strength after a certain water temperature is reached.

As water-soluble materials, films of water-soluble polymers have been known for a long time. As, for example, in the Swiss patent application CH 347930, a separate packaging in bleaches and bleach activators with water-soluble films improves the storage stability of the detergents packaged in this way. In U.S. Pat. No. 3,277,009 it is proposed to use polyvinylpyrrolidone derivatives as materials for the preparation of small water-soluble detergent sacks. DE 4115286 A1 describes bags made of predominantly nonionic cellulose ethers which additionally increase the washing performance.

Auxiliaries and Additives

The compositions according to the invention can further comprise typical auxiliaries and additives, such as, for example, anionic, nonionic, cationic, amphoteric or zwitterionic surfactants, builders, cobuilders, oil- and grease-dissolving substances, bleaches, bleach activators, antiredeposition agents, enzymes, enzyme stabilizers, optical brighteners, polymers, defoamers, disintegrants, fragrances, inorganic salts and the like, as are explained in more detail below.

Anionic Surfactants

Typical examples of anionic surfactants are soaps, alkylbenzenesulfonates, alkanesulfonates, olefin-sulfonates, alkyl ether sulfonates, glycerol ether sulfonates, α-methyl ester sulfonates, sulfo fatty acids, alkylsulfates, fatty alcohol ether sulfates, glycerol ether sulfates, monoglyceride (ether) sulfates, hydroxy mixed ether sulfates, fatty acid amide (ether) sulfates, mono- and dialkyl sulfosuccinates, mono- and dialkyl sulfosuccinamates, sulfotriglycerides, amide soaps, ether carboxylic acids and salts thereof, fatty acid isethionates, fatty acid sarcosinates, fatty acid taurides, N-acylamino acids, such as, for example, acyl lactylates, acyl tartrates, acyl glutamates and acyl aspartates, alkyl oligoglucoside sulfates, protein fatty acid condensates (in particular wheat-based vegetable products) and alkyl (ether) phosphates. If the anionic surfactants contain polyglycol ether chains, these may have a conventional homolog distribution, but preferably have a narrowed homolog distribution. Preference is given to using alkylbenzenesulfonates, alkyl sulfates, soaps, alkanesulfonates, olefinsulfonates, methyl ester sulfonates and mixtures thereof. Preferred alkylbenzenesulfonates conform to the formula (II), $$R^5—Ph—SO_3X \quad (II)$$

in which $R^5$ is a branched, but preferably linear, alkyl radical having 10 to 18 carbon atoms, Ph is a phenyl radical and X is an alkali metal and/or alkaline earth metal, ammonium, alkylammonium, alkanolammonium or glucammonium. Of these, dodecylbenzenesulfonates, tetradecylbenzenesulfonates, hexadecylbenzenesulfonates and technical-grade mixtures thereof in the form of the sodium salts are particularly suitable.

Alkyl and/or alkenyl sulfates, which are also often referred to as fatty alcohol sulfates, are to be understood as meaning the sulfation products of primary and/or secondary alcohols, which preferably conform to the formula (III), $$R^6O—SO_3X \quad (III)$$

in which $R^6$ is a linear or branched, aliphatic alkyl and/or alkenyl radical having 6 to 22, preferably 12 to 18, carbon atoms and X is an alkali metal and/or alkaline earth metal, ammonium, alkylammonium, alkanolammonium or glucammonium. Typical examples of alkyl sulfates which can be used for the purposes of the invention are the sulfation products of caproic alcohol, caprylic alcohol, capric alcohol, 2-ethylhexyl alcohol, lauryl alcohol, myristyl alcohol, cetyl alcohol, palmoleyl alcohol, stearyl alcohol, isostearyl alcohol, oleyl alcohol, elaidyl alcohol, petroselinyl alcohol, arachidyl alcohol, gadoleyl alcohol, behenyl alcohol and erucyl alcohol, and the technical-grade mixtures thereof which are obtained by high-pressure hydrogenation of technical-grade methyl ester fractions or aldehydes from the Roelen oxo synthesis. The sulfation products can preferably be used in the form of their alkali metal salts and in particular their sodium salts. Particular preference is given to alkylsulfates based on $C_{16/18}$-tallow fatty alcohols and vegetable fatty alcohols of comparable carbon chain distribution in the form of their sodium salts. In the case of branched primary alcohols, these are oxo alcohols, as are accessible, for example, by reacting carbon monoxide and hydrogen over α-position olefins in accordance with the Shop process. Such alcohol mixtures are available commercially under the trade name Dobanol® or Neodol®. Suitable alcohol mixtures are Dobanol 91®, 23®, 25®, 45®. A further possibility is oxo alcohols, as are obtained by the classical oxo process from Enichema or from Condea by the addition of carbon monoxide and hydrogen onto olefins. These alcohol mixtures are mixtures of highly branched alcohols. Such alcohol mixtures are available commercially under the trade name Lial®. Suitable alcohol mixtures are Lial 91®, 111®, 123®, 125®, 145®.

Finally, soaps are to be understood as meaning fatty acid salts of the formula (IV), $$R^7CO—OX \quad (IV)$$

in which $R^7CO$ is a linear or branched, saturated or unsaturated acyl radical having 6 to 22 and preferably 12 to 18 carbon atoms and again X is alkali metal and/or alkaline earth metal, ammonium, alkyl ammonium or alkanol ammonium. Typical examples are the sodium, potassium, magnesium, ammonium and triethanolammonium salts of caproic acid, caprylic acid, 2-ethylhexanoic acid, capric acid, lauric acid, isotridecanoic acid, myristic acid, palmitic acid, palmoleic acid, stearic acid, isostearic acid, oleic acid, elaidic acid, petroselic acid, linoleic acid, linolenic acid, eleostearic acid, arachidic acid, gadoleic acid, behenic acid and erucic acid, and technical-grade mixtures thereof. Preference is given to using coconut or palm kernel fatty acid in the form of its sodium or potassium salts.

Nonionic Surfactants

Typical examples of nonionic surfactants are fatty alcohol polyglycol ethers, alkylphenol polyglycol ethers, fatty acid polyglycol esters, fatty acid amide polyglycol ethers, fatty amine polyglycol ethers, alkoxylated triglycerides, mixed ethers or mixed formals, alk(en)yl oligoglycosides, fatty acid N-alkylglucamides, protein hydrolysates (in particular wheat-based vegetable products), polyol fatty acid esters, sugar esters, sorbitan esters, polysorbates and amine oxides. If the nonionic surfactants contain polyglycol ether chains, these may have a conventional homolog distribution, but preferably have a narrowed homolog distribution. Preference is given to using fatty alcohol polyglycol ethers, alkoxylated fatty acid lower alkyl esters or alkyl oligoglucosides. The preferred fatty alcohol polyglycol ethers conform to the formula (V), $$R^8O(CH_2CHR^9O)_{n1}H \quad (V)$$

in which $R^8$ is a linear or branched alkyl and/or alkenyl radical having 6 to 22, preferably 12 to 18, carbon atoms, $R^9$ is hydrogen or methyl and n1 is a number from 1 to 20. Typical examples are the addition products of, on average, 1 to 20 and preferably 5 to 10 mol of ethylene oxide and/or propylene oxide onto caproic alcohol, caprylic alcohol, 2-ethylhexyl alcohol, capric alcohol, lauryl alcohol, isotridecyl alcohol, myristyl alcohol, cetyl alcohol, palmoleyl alcohol, stearyl alcohol, isostearyl alcohol, oleyl alcohol, elaidyl alcohol, petroselinyl alcohol, linolyl alcohol, linolenyl alcohol, eleostearyl alcohol, arachyl alcohol, gadoleyl alcohol, behenyl alcohol, erucyl alcohol and brassidyl alcohol, and technical grade mixtures thereof. Particular preference is given to addition products of 3, 5 or 7 mol of ethylene oxide onto technical-grade coconut fatty alcohols.

Suitable alkoxylated fatty acid lower alkyl esters are surfactants of the formula (VI), $$R^{10}CO—(OCH_2CHR^{11})_{n2}OR^{12} \quad (VI)$$

in which $R^{10}CO$ is a linear or branched, saturated and/or unsaturated acyl radical having 6 to 22 carbon atoms, $R^{11}$ is hydrogen or methyl, $R^{12}$ is linear or branched alkyl radicals having 1 to 4 carbon atoms and n2 is a number from 1 to 20. Typical examples are the formal insertion products of, on average, 1 to 20 and preferably 5 to 10 mol of ethylene oxide and/or propylene oxide into the methyl, ethyl, propyl, isopropyl, butyl and tert-butyl esters of caproic acid, caprylic acid, 2-ethylhexanoic acid, capric acid, lauric acid, isotridecanoic acid, myristic acid, palmitic acid, palmoleic acid, stearic acid, isostearic acid, oleic acid, elaidic acid, petroselic acid, linoleic acid, linolenic acid, eleostearic acid, arachidic acid, gadoleic acid, behenic acid and erucic acid, and technical-grade mixtures thereof. The products are usually prepared by inserting the alkylene oxides into the carbonyl ester bond in the presence of special catalysts, such as, for example, calcined hydrotalcite. Particular preference is given to the reaction products of, on average, 5 to 10 mol of ethylene oxide into the ester bond of technical-grade coconut fatty acid methyl esters.

Alkyl and alkenyl oligoglycosides, which are likewise preferred nonionic surfactants, usually conform to the formula (VII), $$R^{13}O—[G]_p \quad (VII)$$

in which $R^{13}$ is an alkyl and/or alkenyl radical having 4 to 22 carbon atoms, G is a sugar radical having 5 or 6 carbon atoms and p is a number from 1 to 10. They can be obtained by relevant processes of preparative organic chemistry. By way of representative for the extensive literature, reference may be made here to the specifications EP-A1 0301298 and WO 90/03977. The alkyl and/or alkenyl oligoglycosides can be derived from aldoses or ketoses having 5 or 6 carbon atoms, preferably from glucose. The preferred alkyl and/or alkenyl oligoglycosides are thus alkyl and/or alkenyl oligoglucosides. The index number p in the general formula (VII) gives the degree of oligomerization (DP), i.e. the distribution of mono- and oligoglycosides, and is a number between 1 and 10. While p in a given compound must always be an integer and can here primarily assume the values p=1 to 6, the value p for a certain alkyl oligoglycoside is an analytically determined calculated parameter which in most cases is a fraction. Preference is given to using alkyl and/or alkenyl oligoglycosides having an average degree of oligomerization p of from 1.1 to 3.0. From a performance viewpoint, preference is given to those alkyl and/or alkenyl oligoglycosides whose degree of oligomerization is less than 1.7 and is in particular between 1.2 and 1.4. The alkyl or alkenyl radical $R^{13}$ can be derived from primary alcohols having 4 to 11, preferably 8 to 10, carbon atoms. Typical examples are butanol, caproic alcohol, caprylic alcohol, capric alcohol and undecyl alcohol, and technical-grade mixtures thereof, as are obtained, for example, in the hydrogenation of technical-grade fatty acid methyl esters or in the course of the hydrogenation of aldehydes from the Roelen oxo synthesis. Preference is given to alkyl oligoglucosides of chain length $C_8$–$C_{10}$ (DP=1 to 3) which are produced as forerunnings during the distillative separation of technical-grade $C_8$–$C_{18}$-coconut fatty alcohol and may be contaminated with a content of less than 6% by weight of $C_{12}$-alcohol, and also alkyl oligoglucosides based on technical-grade $C_{9/11}$-oxo alcohols (DP=1 to 3). The alkyl or alkenyl radical $R^{13}$ can also be derived from primary alcohols having 12 to 22, preferably 12 to 14, carbon atoms. Typical examples are lauryl alcohol, myristyl alcohol, cetyl alcohol, palmoleyl alcohol, stearyl alcohol, isostearyl alcohol, oleyl alcohol, elaidyl alcohol, petroselinyl alcohol, arachidyl alcohol, gadoleyl alcohol, behenyl alcohol, erucyl alcohol, brassidyl alcohol, and technical-grade mixtures thereof which can be obtained as described above. Preference is given to alkyl oligoglucosides based on hydrogenated $C_{12/14}$-coconut alcohol with a DP of from 1 to 3.

Cationic Surfactants

Typical examples of cationic surfactants are, in particular, tetraalkylammonium compounds, such as, for example, dimethyldistearylammonium chloride or Hydroxyethyl Hydroxycetyl Dimmonium Chloride (Dehyquart E) and also ester quats. These are, for example, quaternized fatty acid triethanolamine ester salts of the formula (VIII)

$$[R^{14}CO-(OCH_2CH_2)_{m1}OCH_2CH_2-\underset{\underset{CH_2CH_2O(CH_2CH_2O)_{m3}R^{17}}{|}}{\overset{\overset{R^{16}}{|}}{N^+}}-CH_2CH_2O-(CH_2CH_2O)_{m2}R^{15}]\ Y^- \quad (VIII)$$

in which $R^{14}CO$ is an acyl radical having 6 to 22 carbon atoms, $R^{15}$ and $R^{16}$, independently of one another, are hydrogen or $R^{14}CO$, $R^{15}$ is an alkyl radical having 1 to 4 carbon atoms or a $(CH_2CH_2O)_{m4}H$ group, m1, m2 and m3 are in total 0 or a number from 1 to 12, m4 is a number from 1 to 12 and Y is halide, alkyl sulfate or alkyl phosphate. Typical examples of ester quats which can be used for the purposes of the invention are products based on caproic acid, caprylic acid, capric acid, lauric acid, myristic acid, palmitic acid, isostearic acid, stearic acid, oleic acid, elaidic acid, arachidic acid, behenic acid and erucic acid, and technical-grade mixtures thereof, as are produced, for example, during the pressurized cleavage of natural fats and oils. Preference is given to using technical-grade $C_{12/18}$-coconut fatty acids and, in particular, partially hydrogenated $C_{16/18}$-tallow or palm fatty acids, and also elaidic acid-rich $C_{16/18}$-fatty acid cuts. To prepare the quaternized esters, the fatty acids and the triethanolamine can be used in the molar ratio of from 1.1:1 to 3:1. With regard to the performance properties of the ester quats, a feed ratio of from 1.2:1 to 2.2:1, preferably 1.5:1 to 1.9:1, has proven particularly advantageous. The preferred ester quats represent technical-grade mixtures of mono-, di- and triesters having an average degree of esterification of from 1.5 to 1.9 and are derived from technical-grade $C_{16/18}$-tallow or palm fatty acid (iodine number 0 to 40). From a performance viewpoint, quaternized fatty acid triethanolamine ester salts of the formula (VIII) in which $R^{14}CO$ is an acyl radical having 16 to 18 carbon atoms, $R^{15}$ is $R^{15}CO$, $R^{16}$ is hydrogen, $R^{17}$ is a methyl group, m1, m2 and m3 are 0 and Y is methyl sulfate have proven particularly advantageous.

In addition to the quaternized fatty acid triethanolamine ester salts, suitable ester quats are also quaternized ester salts of fatty acids with diethanolalkylamines of the formula (IX), (IX)

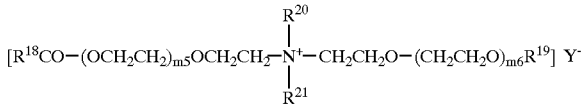

in which $R^{18}CO$ is an acyl radical having 6 to 22 carbon atoms, $R^{19}$ is hydrogen or $R^{18}CO$, $R^{20}$ and $R^{21}$, independently of one another, are alkyl radicals having 1 to 4 carbon atoms, m5 and m6 in total are 0 or a number from 1 to 12 and Y is again halide, alkyl sulfate or alkyl phosphate.

Finally, a further group of suitable ester quats which are to be mentioned are the quaternized ester salts of fatty acids with 1,2-dihydroxypropyldialkylamines of the formula (X), (X)

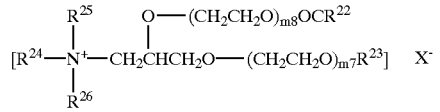

in which $R^{22}CO$ is an acyl radical having 6 to 22 carbon atoms, $R^{23}$ is hydrogen or $R^{22}CO$, $R^{24}$, $R^{25}$ and $R^{26}$, independently of one another, are alkyl radicals having 1 to 4 carbon atoms, m7 and m8 in total are 0 or a number from 1 to 12 and X is again halide, alkyl sulfate or alkyl phosphate.

Finally, suitable ester quats are also substances in which the ester bond is replaced by an amide bond and which conform, preferably based on diethylenetriamine, to the formula (XI), (XI)

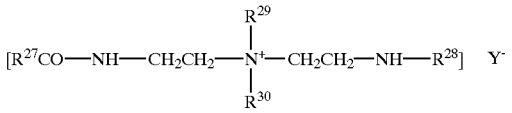

in which $R^{27}CO$ is an acyl radical having 6 to 22 carbon atoms, $R^{28}$ is hydrogen or $R^{27}CO$, $R^{29}$ and $R^{30}$, independently of one another, are alkyl radicals having 1 to 4 carbon atoms and Y is again halide, alkyl sulfate or alkyl phosphate. Such amide ester quats are available commercially, for example, under the brand Incroquat® (Croda).

Amphoteric or Zwitterionic Surfactants

Examples of suitable amphoteric or zwitterionic surfactants are alkylbetaines, alkylamidobetaines, aminopropionates, aminoglycinates, imidazoliniumbetaines and sulfobetaines. Examples of suitable alkylbetaines are the carboxyalkylation products of secondary and, in particular, tertiary amines which conform to the formula (XII), (XII)

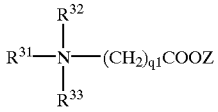

in which $R^{31}$ is alkyl and/or alkenyl radicals having 6 to 22 carbon atoms, $R^{32}$ is hydrogen or alkyl radicals having 1 to 4 carbon atoms, $R^{33}$ is alkyl radicals having 1 to 4 carbon atoms, q1 is a number from 1 to 6 and Z is an alkali metal and/or alkaline earth metal or ammonium. Typical examples are the carboxymethylation products of hexylmethylamine, hexyldimethylamine, octyldimethylamine, decyldimethylamine, dodecylmethylamine, dodecyldimethylamine, dodecylethylmethylamine, $C_{12/14}$-cocoalkyldimethylamine, myristyldimethylamine, cetyldimethylamine, stearyldimethylamine, stearylethylmethylamine, oleyldimethylamine, $C_{16/18}$-tallow-alkyldimethylamine, and technical-grade mixtures thereof.

Also suitable are carboxyalkylation products of amido amines which conform to the formula (XIII), (XIII)

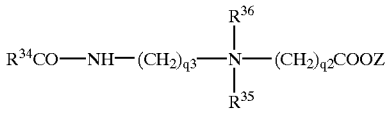

in which $R^{34}CO$ is an aliphatic acyl radical having 6 to 22 carbon atoms and 0 or 1 to 3 double bonds, $R^{35}$ is hydrogen or alkyl radicals having 1 to 4 carbon atoms, $R^{36}$ is alkyl radicals having 1 to 4 carbon atoms, q2 is a number from 1 to 6, q3 is a number from 1 to 3 and Z is again an alkali metal and/or alkaline earth metal or ammonium. Typical examples are reaction products of fatty acids having 6 to 22 carbon atoms, namely caproic acid, caprylic acid, capric acid, lauric acid, myristic acid, palmitic acid, palmoleic acid, stearic acid, isostearic acid, oleic acid, elaidic acid, petroselic acid, linoleic acid, linolenic acid, eleostearic acid, arachidic acid, gadoleic acid, behenic acid and erucic acid, and technical-grade mixtures thereof, with N,N-dimethylaminoethylamine, N,N-dimethylaminopropylamine, N,N-diethylaminoethylamine and N,N-diethylaminopropylamine, which are condensed with sodium chloroacetate. Preference is given to the use of a condensation product of $C_{8/18}$-coconut fatty acid N,N-dimethylaminopropylamide with sodium chloroacetate.

Also suitable are imidazoliniumbetaines. These substances are also known substances, which can be obtained, for example, by cyclizing condensation of 1 or 2 mol of fatty acid with polyfunctional amines, such as, for example, aminoethylethanolamine (AEEA) or diethylenetriamine. The corresponding carboxyalkylation products are mixtures of different open-chain betaines. Typical examples are condensation products of the abovementioned fatty acids with AEEA, preferably imidazolines based on lauric acid or again $C_{12/14}$-coconut fatty acid which are then betainized with sodium chloroacetate.

Builders

The detergents and cleaning agents according to the invention can further comprise additional inorganic and organic builder substances, for example in amounts of from 10 to 50% by weight and preferably 15 to 35% by weight, based on the compositions, where the inorganic builder substances used are primarily zeolites crystalline phyllosilicates, amorphous silicates and, where permissible, also phosphates, such as e.g. tripolyphosphate. The amount of cobuilders is here to be taken into consideration for the preferred amounts of phosphates.

The finely crystalline, synthetic and bonded-water-containing zeolite frequently used as laundry detergent builder is preferably zeolite A and/or P. As zeolite P, particular preference is given, for example, to zeolite MAP® (commercial product from Crosfield). Also suitable, however, are zeolite X and mixtures of A, X and/or P, and also Y. Of particular interest is also a co-crystallized sodium/potassium-aluminum silicate of zeolite A and zeolite X, which is available commercially as VEGOBOND AX® (commercial product from Condea Augusta S.p.A.). The zeolite can be used as a spray-dried powder or else as an undried stabilized suspension still moist from its preparation. In cases where the zeolite is used as suspension, the latter can comprise small additions of nonionic surfactants as stabilizers, for example 1 to 3% by weight, based on zeolite, of ethoxylated $C_{12}$–$C_{18}$-fatty alcohols having 2 to 5 ethylene oxide groups, $C_{12}$–$C_{14}$-fatty alcohols having 4 to 5 ethylene oxide groups or ethoxylated isotridecanols. Suitable zeolites have an average particle size of less than 10 $\mu$m (volume distribution; measurement method: Coulter counter) and preferably comprise 18 to 22% by weight, in particular 20 to 22% by weight, of bonded water.

Suitable substitutes or partial substitutes for phosphates and zeolites are crystalline, layered sodium silicates of the general formula $NaMSi_xO_{2x+1}\cdot yH_2O$, where M is sodium or hydrogen, x is a number from 1.9 to 4 and y is a number from 0 to 20, and preferred values for x are 2, 3, or 4. Such crystalline phyllosilicates are described, for example, in European patent application EP 0164514 A1. Preferred crystalline phyllosilicates of the given formula are those in which M is sodium and x assumes the value 2 or 3. Particular preference is given to both β- and also δ-sodium disilicates $Na_2Si_2O_5\cdot yH_2O$, where β-sodium disilicate can be obtained, for example, by the process described in international patent application wo 91/08171. Further suitable phyllosilicates are known, for example, from the patent applications DE 2334899 A1, EP 0026529 A1 and DE 3526405 A1. Their usability is not limited to a specific composition or structural formula. However, preference is given here to smectites, in particular bentonites. Suitable phyllosilicates which belong to the group of water-swellable smectites are, for example, those of the eneral formulae

| | |
|---|---|
| $(OH)_4Si_{8-y}Al_y(Mg_xAl_{4-x})O_{20}$ | montmorrilonite |
| $(OH)_4Si_{8-y}Al_y(Mg_{6-z}Li_z)P_{20}$ | hectorite |
| $(OH)_4Si_{8-y}Al_y(Mg_{6-z}Al_z)O_{20}$ | saponite |

where x=0 to 4, y=0 to 2, z=0 to 6. In addition, small amounts of iron can be incorporated into the crystal lattice of the phyllosilicates according to the above formulae. In addition, the phyllosilicates can comprise hydrogen, alkali metal and alkaline earth metal ions, in particular $Na^+$ and $Ca^{2+}$ because of their ion-exchanging properties. The amount of water of hydration is in most cases in the range from 8 to 20% by weight and is dependent on the swelling state or on the type of processing. Phyllosilicates which can be used are, for example, known from U.S. Pat. Nos. 3,966,629, 4,062,647, EP 0026529 A1 and EP 0028432 A1. Preference is given to using phyllosilicates which, because of an alkali metal treatment, are largely free from calcium ions and strongly coloring iron ions.

The preferred builder substances also include amorphous sodium silicates with an $Na_2O:SiO_2$ modulus of from 1:2 to 1:3.3, preferably from 1:2 to 1:2.8 and in particular from 1:2 to 1:2.6, which have delayed dissolution and secondary detergency properties. Delayed dissolution compared with conventional amorphous sodium silicates can be brought about in a variety of ways, for example by surface treatment, compounding, compaction/compression or by overdrying. For the purposes of this invention, the term "amorphous" is also to be understood as meaning "X-rayamorphous". This means that, in X-ray diffraction experiments, the silicates do not produce sharp X-ray reflections typical of crystalline substances, but, at best, one or more maxima of the scattered X-ray radiation having a breadth of several degree units of the diffraction angle. However, particularly good builder properties may very likely result if the silicate particles produce poorly defined or even sharp diffraction maxima in electron diffraction experiments. This is to be interpreted to the effect that the products have microcrystalline regions with a size from 10 to a few hundred nm, preference being given to values up to a maximum of 50 nm and in particular up to a maximum of 20 nm. Such so-called X-ray-amorphous silicates, which likewise have delayed dissolution compared with traditional water glasses, are described, for example, in German patent application DE 4400024 A1. Particular preference is given to compressed/compacted amorphous silicates, compounded amorphous silicates and overdried X-ray-amorphous silicates.

The use of the generally known phosphates as builder substances is of course also possible, provided such a use is not to be avoided for ecological reasons. In particular, the sodium salts of the orthophosphates, of the pyrophosphates and, in particular, of the tripolyphosphates, are suitable. Their content is generally not more than 25% by weight, preferably not more than 20% by weight, in each case based on the finished composition. In some cases, it has been found that tripolyphosphates in particular lead to a synergistic improvement in the secondary detergency even in small amounts up to a maximum of 10% by weight, based on the finished composition, in combination with other builder substances.

Cobuilders

Organic framework substances which can be used and are suitable as cobuilders are, for example, the polycarboxylic acids which can be used in the form of their sodium salts, such as citric acid, adipic acid, succinic acid, glutaric acid, tartaric acid, sugar acids, aminocarboxylic acids, nitrilotriacetic acid (NTA), provided such a use is not objectionable for ecological reasons, and mixtures thereof. Preferred salts are the salts of the polycarboxylic acids, such as citric acid, adipic acid, succinic acid, glutaric acid, tartaric acid, sugar acids and mixtures thereof. The acids per se can also be used. In addition to their builder action, the acids typically also have the property of an acidifying component and thus also serve for setting a relatively low and relatively mild pH of detergents or cleaners. In this connection, particular mention may be made of citric acid, succinic acid, glutaric acid, adipic acid, gluconic acid and any mixtures thereof.

Further suitable organic builder substances are dextrins, for example oligomers or polymers of carbohydrates which can be obtained by partial hydrolysis of starches. The hydrolysis can be carried out in accordance with customary, for example acid-catalyzed or enzyme-catalyzed, processes. The hydrolysis products preferably have average molar masses in the range from 400 to 500 000. Here, a polysaccharide with a dextrose equivalent (DE) in the range from 0.5 to 40, in particular from 2 to 30, is preferred, where DE is a usual measure of the reducing action of a polysaccharide compared with dextrose, which has a DE of 100. It is possible to use either maltodextrins with a DE between 3 and 20 and dry glucose syrups with a DE between 20 and 37, and also so-called yellow dextrins and white dextrins with relatively high molar masses in the range from 2000 to 30 000. A preferred dextrin is described in British patent application GB 9419091 A1. The oxidized derivatives of such dextrins are their reaction products with oxidizing agents which are able to oxidize at least one alcohol function of the saccharide ring to give the carboxylic acid function. Such oxidized dextrins and processes for their preparation are known, for example, from European patent applications EP 0232202 A1, EP 0427349 A1, EP 0472042 A1 and EP 0542496 A1, and the international patent applications WO 92/18542, WO 93/08251, WO 93/16110, WO 94/28030, WO 95/07303, WO 95/12619 and WO 95/20608. Also suitable is an oxidized oligosaccharide according to German patent application DE 19600018 A1. A product oxidized on $C_6$ of the saccharide ring may be particularly advantageous.

Further suitable co-builders are oxydisuccinates and other derivatives of disuccinates, preferably ethylenediamine disuccinate. Particular preference is also given in this connection to glycerol disuccinates and glycerol trisuccinates, as are described, for example, in US-American patent specifications U.S. Pat. Nos. 4,524,009, 4,639,325, in the European patent application EP 0150930 A1 and the Japanese patent application JP 93/339896. Suitable use amounts in zeolite-containing and/or silicate-containing formulations are 3 to 15% by weight. Further organic co-builders which can be used are, for example, acetylated hydroxycarboxylic acids or salts thereof, which may optionally also be in lactone form and which contain at least 4 carbon atoms and at least one hydroxyl group and a maximum of two acid groups. Such co-builders are described, for example, in international patent application WO 95/20029.

Suitable polymeric polycarboxylates are, for example, the sodium salts of polyacrylic acid or of polymethacrylic acid, for example those with a relative molecular mass of from 800 to 150 000 (based on acid and in each case measured against polystyrenesulfonic acid). Suitable copolymeric polycarboxylates are, in particular, those of acrylic acid with methacrylic acid and of acrylic acid or methacrylic acid with maleic acid. Copolymers of acrylic acid with maleic acid which contain 50 to 90% by weight of acrylic acid and 50 to 10% by weight of maleic acid have proven particularly suitable. Their relative molecular mass, based on free acids, is generally 5000 to 200 000, preferably 10 000 to 120 000 and in particular 50 000 to 100 000 (in each case measured against polystyrenesulfonic acid). The (co)polymeric polycarboxylates can either be used as powder or as aqueous solution, preference being given to 20 to 55% by weight strength aqueous solutions. Granular polymers are in most cases added subsequently to one or more base granulates. Particular preference is also given to biodegradable polymers of more than two different monomer units, for example those which, according to DE 4300772 A1, contain salts of acrylic acid and of maleic acid and vinyl alcohol or vinyl alcohol derivatives as monomers, or, according to DE 4221381 C2, salts of acrylic acid and of 2-alkylallylsulfonic acid and sugar derivatives as monomers. Further preferred copolymers are those which are described in German patent applications DE 4303320 A1 and DE 4417734 A1 and have, as monomers, preferably acrolein and acrylic acid/acrylic acid salts or acrolein and vinyl acetate. Further preferred builder substances are also polymeric aminodicarboxylic acids, salts thereof or precursor substances thereof. Particular preference is given to polyaspartic acids or salts and derivatives thereof.

Further suitable builder substances are polyacetals, which can be obtained by reacting dialdehydes with polyolcarboxylic acids which have 5 to 7 carbon atoms and at least 3 hydroxyl groups, for example as described in European patent application EP 0280223 A1. Preferred polyacetals, are obtained from dialdehydes such as glyoxal, glutaraldehyde, terephthalaldehyde and mixtures thereof and from polyolcarboxylic acids such as gluconic acid and/or glucoheptonic acid.

Oil- and Grease-dissolving Substances

In addition, the compositions can also comprise components which have a positive effect on the ability to wash oil and grease out of textiles. Preferred oil- and grease-dissolving components include, for example, nonionic cellulose ethers, such as methylcellulose and methylhydroxypropylcellulose having a proportion of methoxy groups of from 15 to 30% by weight and of hydroxypropoxy groups of from 1 to 15% by weight, in each case based on the nonionic cellulose ethers, and the polymers, known from the prior art, of phthalic acid and/or of terephthalic acid, or of derivatives thereof, in particular polymers of ethylene terephthalates and/or polyethylene glycol terephthalates or anionically and/or nonionically modified derivatives thereof. Of these, particular preference is given to the sulfonated derivatives of phthalic acid and of terephthalic acid polymers.

Bleaches and Bleach Activators

Among the compounds which supply $H_2O_2$ in water and which serve as bleaches, sodium perborate tetrahydrate and sodium perborate monohydrate are of particular importance. Further bleaches which can be used are, for example, sodium percarbonate, peroxypyrophosphates, citrate perhydrates, and $H_2O_2$-supplying peracidic salts or peracids, such as perbenzoates, peroxophthalates, diperazelaic acid, phthaloimino peracid or diperdodecanedioic acid. The content of bleaches in the compositions is preferably 5 to 35% by weight and in particular up to 30% by weight, where perborate monohydrate or percarbonate is used advantageously. Bleach activators which can be used are compounds which, under perhydrolysis conditions, produce aliphatic peroxocarboxylic acids having, preferably, 1 to 10 carbon atoms, in particular 2 to 4 carbon atoms, and/or optionally substituted perbenzoic acid. Substances which carry O- and/or N-acyl groups of said number of carbon atoms and/or optionally substituted benzoyl groups are suitable. Preference is given to polyacylated alkylenediamines, in particular tetraacetylethylenediamine (TAED), acylated triazine derivatives, in particular 1,5-diacetyl-2,4-dioxohexahydro-1,3,5-triazine (DADHT), acylated glycolurils, in particular tetraacetylglycoluril (TAGU), N-acylimides, in particular N-nonanoylsuccinimide (NOSI), acylated phenolsulfonates, in particular n-nonanoyl- or isononanoyloxybenzenesulfonate (n- or iso-NOBS), carboxylic anhydrides, in particular phthalic anhydride, acylated polyhydric alcohols, in particular triacetin, ethylene glycol diacetate, 2,5-diacetoxy-2,5-dihydrofuran and the enol esters known from German patent applications DE 19616693 A1 and DE 19616767 A1, and acetylated sorbitol and mannitol or mixtures thereof described in European patent application EP 0525239 A1 (SORMAN), acylated sugar derivatives, in particular pentaacetylglucose (PAG), pentaacetylfructose, tetraacetylxylose and octaacetyllactose, and acetylated, optionally N-alkylated glucamine and gluconolactone, and/or N-acylated lactams, for example N-benzoylcaprolactam, which are known from international patent applications WO 94/27970, WO 94/28102, WO 94/28103, WO 95/00626, WO 95/14759 and WO 95/17498. The hydrophilically substituted acylacetals known from German patent application DE 19616769 A1, and the acyllactams described in German patent application DE 196 16 770 and international patent application WO 95/14075 are likewise used with preference. Combinations of conventional bleach activators known from German patent application DE 4443177 A1 can also be used. Such bleach activators are present in the customary quantitative range, preferably in amounts of from 1% by weight to 10% by weight, in particular 2% by weight to 8% by weight, based on the overall composition. In addition to the above-listed conventional bleach activators, or instead of them, the sulfonimines known from European patent specifications EP 0446982 B1 and EP 0453 003 B1 and/or bleach-boosting transition metal salts or transition metal complexes may also be present as so-called bleach catalysts. Suitable transition metal compounds include, in particular, the manganese-, iron-, cobalt-, ruthenium- or molybdenum-salen complexes known from German patent application DE 19529905 A1, and their N-analogous compounds known from German patent application DE 19620267 A1, the manganese-, iron-, cobalt-, ruthenium- or molybdenum-carbonyl carbonyl complexes known from German patent application DE 19536082 A1, the manganese, iron, cobalt, ruthenium, molybdenum, titanium, vanadium and copper complexes having nitrogen-containing tripod ligands described in German patent application DE 19605688 A1, the cobalt-, iron-, copper- and ruthenium-amine complexes known from German patent application DE 19620411 A1, the manganese, copper and cobalt complexes described in German patent application DE 4416438 A1, the cobalt complexes described in European patent application EP 0272030 A1, the manganese complexes known from European patent application EP 0693550 A1, the manganese, iron, cobalt and copper complexes known from European patent specification EP 0392592 A1, and/or the manganese complexes described in European patent specification EP 0443651 B1 or European patent applications EP 0458397 Al, EP 0458398 A1, EP 0549271 A1, EP 0549272 A1, EP 0544490 A1 and EP 0544519 A1. Combinations of bleach activators and transition metal bleach catalysts are known, for example, from German patent application DE 19613103 A1 and international patent application WO 95/27775. Bleach-boosting transition metal complexes, in particular with the central atoms Mn, Fe, Co, Cu, Mo, V, Ti and/or Ru, are used in customary amounts, preferably in an amount up to 1% by weight, in particular from 0.0025% by weight to 0.25% by weight and particularly preferably from 0.01% by weight to 0.1% by weight, in each case based on the overall composition.

Enzymes and Enzyme Stabilizers

Suitable enzymes are, in particular, those from the class of hydrolases, such as proteases, esterases, lipases or enzymes with lipolytic action, amylases, cellulases or other glycosyl-hydrolases and mixtures of said enzymes. All of these hydrolases contribute during washing to the removal of stains, such as protein, grease or starchy stains, and redeposition. Cellulases and other glycosyl hydrolases may, by removing pilling and microfibrils, contribute to color retention and to an increase in the softness of the textile. For bleaching or for inhibiting color transfer, it is also possible to use oxidoreductases. Particularly suitable enzymatic active ingredients are those obtained from bacterial strains or fungi, such as *Bacillus subtilis, Bacillus licheniformis, Streptomyces griseus* and *Humicola insolens*. Preference is given to using proteases of the subtilisin type and, in particular, proteases obtained from *Bacillus lentus*. Of particular interest in this connection are enzyme mixtures, for example mixtures of protease and amylase or protease and lipase or lipolytic enzymes, or protease and cellulase or of cellulase and lipase or lipolytic enzymes or of protease, amylase and lipase or lipolytic enzymes or protease, lipase or lipolytic enzymes and cellulase, in particular, however, protease- and/or lipase-containing mixtures or mixtures containing lipolytic enzymes. Examples of such lipolytic enzymes are the known cutinases. Peroxidases or oxidases have also proven suitable in some cases. Suitable amylases include, in particular, α-amylases, isoamylases, pullulanases and pectinases. The cellulases used are preferably cellobiohydrolases, endoglucanases and β-glucosidases, which are also called cellobiases, or mixtures thereof. Since the various cellulase types differ in their CMCase and avicelase activities, it is possible to adjust the desired activities through targeted mixing of the cellulases.

The enzymes can be adsorbed on carrier substances and/or embedded in coating substances in order to protect them against premature decomposition. The proportion of enzymes, enzyme mixtures or enzyme granulates can, for example, be from about 0.1 to 5% by weight, preferably 0.1 to about 2% by weight.

In addition to the mono- and polyfunctional alcohols, the compositions can comprise further enzyme stabilizers. For example, 0.5 to 1% by weight of sodium formate can be used. The use of proteases which have been stabilized with soluble calcium salts and a calcium content of, preferably, about 1.2% by weight, based on the enzyme, is also possible. Apart from calcium salts, magnesium salts also serve as stabilizers. However, the use of boron compounds, for example of boric acid, boron oxide, borax and other alkali metal borates, such as the salts of orthoboric acid ($H_3BO_3$), of metaboric acid ($HBO_2$) and of pyroboric acid (tetraboric acid $H_2B_4O_7$) is particularly advantageous.

Antiredeposition Agents

Antiredeposition agents have the task of keeping the soil detached from the fiber in suspended form in the liquor, and thus preventing reattachment of the soil. For this purpose, water-soluble colloids of a mostly organic nature are suitable, for example the water-soluble salts of polymeric carboxylic acids, glue, gelatin, salts of ether carboxylic acids or ether sulfonic acids of starch or of cellulose or salts of acidic sulfuric esters of cellulose or of starch. Water-soluble polyamides which contain acidic groups are also suitable for this purpose. In addition, it is also possible to use soluble starch preparations, and starch products other than those mentioned above, e.g. degraded starch, aldehyde starches etc. Polyvinyl-pyrrolidone can also be used. Preference is, however, given to using cellulose ethers, such as carboxymethyl-cellulose (Na salt), methylcellulose, hydroxyalkyl-cellulose and mixed ethers, such as methylhydroxyethyl-cellulose, methylhydroxypropyl-cellulose, methyl-carboxymethylcellulose and mixtures thereof, and polyvinylpyrrolidone, for example in amounts of from 0.1 to 5% by weight, based on the compositions.

Optical Brighteners

The compositions can comprise derivatives of diaminostilbenedisulfonic acid, or alkali metal salts thereof, as optical brightners. For example, salts of 4,4'-bis(2-anilino-4-morpholino-1,3,5-triazinyl-6-amino)stilbene-2,2'-disulfonic acid or compounds constructed in a similar way which carry a diethanolamino group, a methylamino group, an anilino group or a 2-methoxyethylamino group instead of the morpholino group are suitable. Brightners of the substituted diphenylstyryl type may also be present, e.g. the alkali metal salts of 4,4'-bis(2-sulfostyryl)diphenyl, 4,4'-bis(4-chloro-3-sulfostyryl)-diphenyl, or 4-(4-chlorostyryl)-4'-(2-sulfostyryl)-diphenyl. Mixtures of the abovementioned brighteners may also be used. Uniformly white granulates are obtained if the compositions comprise, in addition to the customary brighteners in customary amounts, for example between 0.1 and 0.5% by weight, preferably between 0.1 and 0.3% by weight, also small amounts, for example $10^{-6}$ to $10^{-3}$% by weight, preferably around $10^{-5}$% by weight, of a blue dye. A particularly preferred dye is Tinolux® (commercial product from Ciba-Geigy).

Polymers

Suitable soil-repellent polymers are those which preferably contain ethylene terephthalate and/or polyethylene glycol terephthalate groups, where the molar ratio of ethylene terephthalate to polyethylene glycol terephthalate may be in the range from 50:50 to 90:10. The molecular weight of the linking polyethylene glycol units is, in particular, in the range from 750 to 5000, i.e. the degree of ethoxylation of the polyethylene glycol group-containing polymers may be about 15 to 100. The polymers are characterized by an average molecular weight of about 5000 to 200 000 and can have a block structure, but preferably have a random structure. Preferred polymers are those with ethylene terephthalate/polyethylene glycol terephthalate molar ratios of from about 65:35 to about 90:10, preferably from about 70:30 to 80:20. Also preferred are those polymers which have linking polyethylene glycol units with a molecular weight of from 750 to 5000, preferably from 1000 to about 3000 and a molecular weight of the polymer from about 10 000 to about 50 000. Examples of commercially available polymers are the products Milease® T (ICI) or Repelotex® SRP 3 (Rhône-Poulenc).

Defoamers

Defoamers which can be used are wax-like compounds. "Wax-like" is to be understood as meaning those compounds which have a melting point at atmospheric pressure above 25° C. (room temperature), preferably above 50° C. and in particular above 70° C. The wax-like defoamer substances are virtually insoluble in water, i.e. at 20° C. they have a solubility below 0.1% by weight in 100 g of water. In principle, all wax-like defoamer substances known from the prior art may be present. Suitable wax-like compounds are, for example, bisamides, fatty alcohols, fatty acids, carboxylic esters of mono- and polyhydric alcohols, and paraffin waxes or mixtures thereof. Alternatively, the silicone compounds known for this purpose can of course also be used.

Suitable paraffin waxes are generally a complex mixture of substances without a sharp melting point. For characterization, its melting range is usually determined by differential thermoanalysis (DTA), as described in "The Analyst" 87 (1962), 420, and/or its solidification point. This is to be understood as meaning the temperature at which the paraffin converts from the liquid state to the solid state by slow cooling. Here, paraffins which are entirely liquid at room temperature, i.e. those with a solidification point below 25° C., cannot be used according to the invention. The soft waxes, which have a melting point in the range from 35 to 50° C., preferably include the group of petrolatums and hydrogenation products thereof. They are composed of microcrystalline paraffins and up to 70% by weight of oil, have an ointment-like to plastically solid consistency and represent bitumen-free residues from petroleum refining. Particular preference is given to distillation residues (petrolatum stock) of certain paraffin-base and mixed-base crude oils which are further processed to give vaseline. Preferably, they are also bitumen-free, oil-like to solid hydrocarbons deposited from distillation residues of paraffin-base and mixed-base crude oils and cylinder oil distillates by means of solvents. They are of semisolid, viscous, tacky or plastically-solid consistency and have melting points between 50 and 70° C. These petrolatums represent the most important starting base for the preparation of microcrystalline waxes. Also suitable are the solid hydrocarbons having melting points between 63 and 79° C. deposited from high-viscosity, paraffin-containing lubricating oil distillates during deparaffinization. These petrolatums are mixtures of microcrystalline waxes and high-melting n-paraffins. It is possible to use, for example, the paraffin wax mixtures known from EP 0309931 A1 which are composed of, for example, 26% by weight to 49% by weight of microcrystalline paraffin wax with a solidification point of 62° C. to 90° C., 20% by weight to 49% by weight of hard paraffin with a solidification point of 42° C. to 56° C. and 2% by weight to 25% by weight of soft paraffin with a solidification point of from 35° C. to 40° C. Preference is given to using paraffins or paraffin mixtures which solidify in the range from 30° C. to 90° C. In this connection, it is to be taken into consideration that even paraffin wax mixtures which appear to be solid at room temperature may also comprise varying proportions of liquid paraffin. In the case of the paraffin waxes which can be used according to the invention, this liquid proportion is as low as possible and is preferably not present at all. Thus, particularly preferred paraffin wax mixtures have a liquid content at 30° C. of less than 10% by weight, in particular of from 2% by weight to 5% by weight, at 40° C. a liquid content of less than 30% by weight, preferably of from 5% by weight to 25% by weight and in particular from 5% by weight to 15% by weight, at 60° C. a liquid content of from 30% by weight to 60% by weight, in particular from 40% by weight to 55% by weight, at 80° C. a liquid content of from 80% by weight to 100% by weight and at 90° C. a liquid content of 100% by weight. The temperature at which a liquid content of 100% by weight of the paraffin wax is achieved is, in the case of particularly preferred paraffin wax mixtures, still below 85° C., in particular 75° C. to 82° C. The paraffin waxes may be petrolatum, microcrystalline waxes or hydrogenated or partially hydrogenated paraffin waxes.

Suitable bisamides as defoamers are those which are derived from saturated fatty acids having 12 to 22, preferably 14 to 18, carbon atoms, and from alkylenediamines having 2 to 7 carbon atoms. Suitable fatty acids are lauric acid, myristic acid, stearic acid, arachidic acid and behenic acid, and mixtures thereof, as are obtainable from natural fats or hydrogenated oils, such as tallow or hydrogenated palm oil. Suitable diamines are, for example, ethylenediamine, 1,3-propylenediamine, tetramethylenediamine, pentamethylenediamine, hexamethylenediamine, p-phenylenediamine and tolylenediamine. Preferred diamines are ethylenediamine and hexamethylenediamine. Particularly preferred bisamides are bismyristoylethylenediamine, bispalmitoylethylenediamine, bis-stearoylethylenediamine and mixtures thereof, and the corresponding derivatives of hexamethylenediamine.

Suitable carboxylic esters as defoamers are derived from carboxylic acids having 12 to 28 carbon atoms; in particular, these are esters of behenic acid, stearic acid, hydroxystearic acid, oleic acid, palmitic acid, myristic acid and/or lauric acid. The alcohol moiety of the carboxylic ester comprises a mono- or polyhydric alcohol having from 1 to 28 carbon atoms in the hydrocarbon chain. Examples of suitable alcohols are behenyl alcohol, arachidyl alcohol, cocoyl alcohol, 12-hydroxystearyl alcohol, oleyl alcohol and lauryl alcohol, and also ethylene glycol, glycerol, polyvinyl alcohol, sucrose, erythritol, pentaerythritol, sorbitan and/or sorbitol. Preferred esters are those of ethylene glycol, glycerol and sorbitan, where the acid moiety of the ester is, in particular, chosen from behenic acid, stearic acid, oleic acid, palmitic acid or myristic acid. Suitable esters of polyhydric alcohols are, for example, xylitol monopalmitate, pentaerythritol monostearate, glycerol monostearate, ethylene glycol monostearate and sorbitan monostearate, sorbitan palmitate, sorbitan monolaurate, sorbitan dilaurate, sorbitan distearate, sorbitan dibehenate, sorbitan dioleate, and mixed tallow alkyl sorbitan monoesters and diesters. Glycerol esters which can be used are the mono-, di- or triesters of glycerol and said carboxylic acids, preference being given to the mono- or diesters. Glycerol monostearate, glycerol monooleate, glycerol monopalmitate, glycerol monobehenate and glycerol distearate are examples thereof. Examples of suitable natural esters as defoamers are beeswax, which consists primarily of the esters $CH_3(CH_2)_{24}COO(CH_2)_{27}CH_3$ and $CH_3(CH_2)_{26}COO(CH_2)_{25}CH_3$, and carnauba wax, which is a mixture of carnaubic acid alkyl esters, often in combination with small amounts of free carnaubic acid, further long-chain acids, high molecular weight alcohols and hydrocarbons.

Suitable carboxylic acids as further defoamer compound are, in particular, behenic acid, stearic acid, oleic acid, palmitic acid, myristic acid and lauric acid, and mixtures thereof as are obtainable from natural fats or optionally hydrogenated oils, such as tallow or hydrogenated palm oil. Preference is given to saturated fatty acids having 12 to 22, in particular 18 to 22, carbon atoms. In the same manner, the corresponding fatty alcohols of equal carbon chain length can be used.

In addition, dialkyl ethers may additionally be present as defoamers. The ethers may have an asymmetrical or symmetrical structure, i.e. contain two identical or different alkyl chains, preferably having 8 to 18 carbon atoms. Typical examples are di-n-octyl ether, di-isooctyl ether and di-n-stearyl ether. Dialkyl ethers which have a melting point above 25° C., in particular above 40° C. are particularly suitable. Further suitable defoamer compounds are fatty ketones, which can be obtained in accordance with the relevant methods of preparative organic chemistry. They are prepared, for example, starting from carboxylic acid magnesium salts, which are pyrolyzed at temperatures above 300° C. with elimination of carbon dioxide and water, for example in accordance with German laid-open specification DE 2553900 A. Suitable fatty ketones are those which are prepared by pyrolysis of the magnesium salts of lauric acid, myristic acid, palmitic acid, palmitoleic acid, stearic acid, oleic acid, elaidic acid, petroselic acid, arachidic acid, gadoleic acid, behenic acid or erucic acid.

Further suitable defoamers are fatty acid polyethylene glycol esters, which are preferably obtained by homogeneous base-catalyzed addition reaction of ethylene oxide with fatty acids. In particular, the addition reaction of ethylene oxide with the fatty acids is carried out in the presence of alkanolamines as catalysts. The use of alkanolamines, specifically triethanolamine, leads to an extremely selective ethoxylation of the fatty acids, particularly when the aim is to prepare compounds which have a low degree of ethoxylation. Within the group of fatty acid polyethyleneglycol esters, preference is given to those which have a melting point above 25° C., in particular above 40° C.

Within the group of wax-like defoamers, particular preference is given to the paraffin waxes described used alone as wax-like defoamers, or in a mixture with one of the other wax-like defoamers, where the proportion of paraffin waxes in the mixture preferably constitutes more than 50% by weight, based on wax-like defoamer mixture. The paraffin waxes can be applied to supports as required. Suitable carrier materials are all known inorganic and/or organic carrier materials. Examples of typical inorganic carrier materials are alkali metal carbonates, aluminosilicates, water-soluble phyllosilicates, alkali metal silicates, alkali metal sulfates, for example sodium sulfate, and alkali metal phosphates. The alkali metal silicates are preferably a compound with an alkali metal oxide to $SiO_2$ molar ratio of from 1:1.5 to 1:3.5. The use of such silicates results in particularly good particle properties, in particular high abrasion stability and nevertheless a high dissolution rate in water. The aluminosilicates referred to as carrier material include, in particular, the zeolites, for example zeolite NaA and NaX. The compounds referred to as water-soluble phyllosilicates include, for example, amorphous or crystalline water glass. In addition, it is possible to use silicates which are available commercially under the name Aerosil® or Sipernat®. Suitable organic carrier materials are, for example, film-forming polymers, for example polyvinyl alcohols, polyvinylpyrrolidones, poly(meth)acrylates, polycarboxylates, cellulose derivatives and starch. Cellulose ethers which can be used are, in particular, alkali metal carboxymethylcellulose, methylcellulose, ethylcellulose, hydroxyethylcellulose and cellulose mixed ethers, such as, for example, methylhydroxyethyl-cellulose and methylhydroxypropylcellulose, and mixtures thereof. Particularly suitable mixtures are composed of sodium carboxymethylcellulose and methyl-cellulose, where the carboxymethylcellulose usually has a degree of substitution of from 0.5 to 0.8 carboxy-methyl groups per anhydroglucose unit and the methyl-cellulose has a degree of substitution of from 1.2 to 2 methyl groups per anhydroglucose unit. The mixtures preferably comprise alkali metal carboxymethylcellulose and nonionic cellulose ethers in weight ratios of from 80:20 to 40:60, in particular from 75:25 to 50:50. A suitable carrier is also natural starch which is composed of amylose and amylopectin. Natural starch is the term used to describe starch such as is available as an extract from natural sources, for example from rice, potatoes, corn and wheat. Natural starch is a commercially available product and thus readily available. As carrier materials it is possible to use one or more of the compounds mentioned above, in particular chosen from the group of alkali metal carbonates, alkali metal sulfates, alkali metal phosphates, zeolites, water-soluble phyllosilicates, alkali metal silicates, polycarboxylates, cellulose ethers, polyacrylate/polymethacrylate and starch. Particularly suitable mixtures are those of alkali metal carbonates, in particular sodium carbonate, alkali metal silicates, in particular sodium silicate, alkali metal sulfates, in particular sodium sulfate and zeolites.

Suitable silicones are customary organopolysiloxanes which may have a content of finely divided silica, which in turn may also be silanized. Such organo-polysiloxanes are described, for example, in European patent application EP 0496510 A1. Particular preference is given to polydiorganosiloxanes and, in particular, polydimethylsiloxanes which are known from the prior art. Suitable polydiorganosiloxanes have a virtually linear chain and have a degree of oligomerization of from 40 to 1500. Examples of suitable substituents are methyl, ethyl, propyl, isobutyl, tert-butyl and phenyl. Also suitable are amino-, fatty acid-, alcohol-, polyether-, epoxy-, fluorine-, glycoside- and/or alkyl-modified silicone compounds, which may either be liquid or in resin form at room temperature. Also suitable are simethicones, which are mixtures of dimethicones having an average chain length of from 200 to 300 dimethylsiloxane units and hydrogenated silicates. As a rule, the silicones generally, and the polydiorganosiloxanes in particular, contain finely divided silica, which may also be silanized. For the purposes of the present invention, silica-containing dimethylpolysiloxanes are particularly suitable. The polydiorganosiloxanes advantageously have a Brookfield viscosity at 25° C. (spindle 1, 10 rpm) in the range from 5000 mPas to 30 000 mpas, in particular from 15 000 to 25 000 mPas. The silicones are preferably used in the form of their aqueous emulsions. The silicone is generally added to an initial charge of water with stirring. If desired, in order to increase the viscosity of the aqueous silicone emulsions, it is possible to add thickeners, as are known from the prior art. These may be inorganic and/or organic in nature, and particular preference is given to nonionic cellulose ethers, such as methylcellulose, ethylcellulose and mixed ethers, such as methylhydroxyethylcellulose, methylhydroxypropylcellulose, methylhydroxybutylcellulose, and anionic carboxycellulose products, such as carboxymethylcellulose sodium salt (abbreviation CMC). Particularly suitable thickeners are mixtures of CMC to nonionic cellulose ethers in the weight ratio 80:20 to 40:60, in particular 75:25 to 60:40. Usually, and particularly in the case of the addition of the described thickener mixtures, recommended use concentrations are from about 0.5 to 10% by weight, in particular from 2.0 to 6% by weight, calculated as thickener mixture and based on aqueous silicone emulsion. The content of silicones of the type described in the aqueous emulsions is advantageously in the range from 5 to 50% by weight, in particular from 20 to 40% by weight, calculated as silicones and based on aqueous silicone emulsion. According to a further advantageous embodiment, the aqueous silicone solutions receive, as thickener, starch accessible from natural sources, for example from rice, potatoes, corn and wheat. The starch is advantageously present in amounts of from 0.1 up to 50% by weight, based on silicone emulsion and, in particular, in a mixture with the already described thickener mixtures of sodium carboxymethylcellulose and a nonionic cellulose ether in the amounts already given. To prepare the aqueous silicone emulsions, the procedure expediently involves allowing the optionally present thickeners to preswell in water before adding the silicones. The silicones are expediently incorporated using effective stirring and mixing devices.

Disintegrants

The solid preparations can further comprise disintegrants. This term is to be understood as meaning substances which are added to the shaped bodies in order to accelerate their disintegration upon contact with water. Overviews on this subject can be found, for example, in J. Pharm. Sci. 61 (1972), Römpp Chemilexikon, $9^{th}$ Edition, Volume 6, p. 4440 and Voigt "Lehrbuch der pharmazeutischen Technologie" [Textbook of Pharmaceutical Technology] ($6^{th}$ Edition, 1987, pp. 182–184). These substances increase in volume upon ingress of water, with on the one hand an increase in the intrinsic volume (swelling) and on the other hand, by way of release of gases as well, the possibility of generating a pressure which causes the tablet to disintegrate into smaller particles. Examples of established disintegration auxiliaries are carbonate/citric acid systems, with the use of other organic acids also being possible. Examples of swelling disintegration auxiliaries are synthetic polymers such as optionally crosslinked polyvinylpyrrolidone (PVP) or natural polymers and/or modified natural substances such as cellulose and starch and their derivatives, alginates or casein derivatives. Preferred disintegrants used for the purposes of the present invention are disintegrants based on cellulose. Pure cellulose has the formal gross composition $(C_6H_{10}O_5)_n$, and, considered formally, is a β-1,4-polyacetal of cellobiose, which itself is constructed from two molecules of glucose. Suitable celluloses consist of about 500 to 5000 glucose units and, accordingly, have average molar masses of from 50 000 to 500 000. Cellulose-based disintegrants which can be used for the purposes of the present invention are also cellulose derivatives obtainable by polymer-analogous reactions from cellulose. Such chemically modified celluloses include, for example, products of esterifications and etherifications in which hydroxyl hydrogen atoms have been substituted. However, celluloses in which the hydroxyl groups have been replaced by functional groups not attached via an oxygen atom may also be used as cellulose derivatives. The group of cellulose derivatives includes, for example, alkali metal celluloses, carboxymethylcellulose (CMC), cellulose esters and ethers and also aminocelluloses. Said cellulose derivatives are preferably not used alone as cellulose-based disintegrants, but instead are used in a mixture with cellulose. The cellulose derivative content of these mixtures is preferably less than 50% by weight, particularly preferably less than 20% by weight, based on the cellulose-based disintegrant. A particularly preferred cellulose-based disintegrant used is pure cellulose which is free from cellulose derivatives. A further cellulose-based disintegrant, or constituent of this component, which may be used is microcrystalline cellulose. This microcrystalline cellulose is obtained by partial hydrolysis of celluloses under conditions which attack only the amorphous regions (approximately 30% of the total cellulose mass) of the celluloses and break them up completely, but leave the crystalline regions (about 70%) intact. Subsequent deaggregation of the microfine celluloses resulting from the hydrolysis yields the microcrystalline celluloses, which have primary particle sizes of approximately 5 μm and can be compacted, for example, to give granulates having an average particle size of 200 μm. The disintegrants can, viewed macroscopically, be homogeneously distributed within the shaped body, but, viewed microscopically, form zones of increased concentration as a result of the preparation. Disintegrants which may be present for the purposes of the invention, such as, for example, kollidon, alginic acid and alkali metal salts thereof, amorphous and also partially crystalline phyllosilicates (bentonites), polyacrylates, polyethylene glycols are given, for example, in the printed specifications WO 98/40462 (Rettenmaier), WO 98/55583 and WO 98/55590 (Unilever) and WO 98/40463, DE 19709991 and DE 19710254 A1 (Henkel). Reference is expressly made to the teaching of these specifications. The shaped bodies can comprise the disintegrants in amounts of from 0.1 to 25% by weight, preferably 1 to 20% by weight and in particular 5 to 15% by weight, based on the shaped bodies.

Fragrances

Perfume oils or fragrances which can be used are individual fragrance compounds, e.g. the synthetic products of the ester, ether, aldehyde, ketone, alcohol and hydrocarbon type. Fragrance compounds of the ester type are, for example, benzyl acetate, phenoxyethyl isobutyrate, p-tert-butylcyclohexyl acetate, linalyl acetate, dimethylbenzylcarbinyl acetate, phenylethyl acetate, linalyl benzoate, benzyl formate, ethyl methylphenylglycinate, allyl cyclohexylpropionate, styrallyl propionate and benzyl salicylate. The ethers include, for example, benzyl ethyl ether; the aldehydes include, for example, the linear alkanals having 8–18 carbon atoms, citral, citronellal, citronellyloxyacetaldehyde, cyclamen aldehyde, hydroxycitronellal, lillial and bourgeonal; the ketones include, for example, the ionones, α-isomethylionone and methyl cedryl ketone; the alcohols include anethole, citronellol, eugenol, geraniol, linalool, phenylethyl alcohol and terpineol; the hydrocarbons include primarily the terpenes, such as limonene and pinene. Preference is, however, given to using mixtures of different fragrances, which together produce an appealing fragrance note. Such perfume oils can also comprise natural fragrance mixtures, such as are obtainable from vegetable sources, e.g. pine oil, citrus oil, jasmine oil, patchouli oil, rose oil or ylang ylang oil. Likewise suitable are muscatel, sage oil, camomile oil, clove oil, balm oil, mint oil, cinnamon leaf oil, lime blossom oil, juniper berry oil, vetiver oil, olibanum oil, galbanum oil and labdanum oil, and orange blossom oil, neroli oil, orange peel oil and sandalwood oil.

The fragrances can be incorporated directly into the compositions according to the invention, although it is also advantageous to apply the fragrances to carriers which enhance the adhesion of the perfume to the laundry and, as a result of a slower release of fragrance, ensure long-lasting fragrance of the textiles. Cyclodextrins have, for example, proven successful as such carrier materials, where the cyclodextrin-perfume complexes can also additionally be coated with further auxiliaries.

Inorganic Salts

Further suitable ingredients of the compositions are water-soluble inorganic salts, such as bicarbonates, carbonates, amorphous silicates, normal waterglasses, which do not have prominent builder properties, or mixtures thereof; in particular, alkali metal carbonate and/or amorphous alkali metal silicate, primarily sodium silicate with an $Na_2O:SiO_2$ molar ratio of from 1:1 to 1:4.5, preferably from 1:2 to 1:3.5, are used. The content of sodium carbonate in the end preparations is here preferably up to 40% by weight, advantageously between 2 and 35% by weight. The content of sodium silicate (without particular builder properties) in the compositions is generally up to 10% by weight and preferably between 1 and 8% by weight. Fillers and extenders which may be present are also, for example, sodium sulfate in amounts of from 0 to 10% by weight, in particular 1 to 5% by weight, based on compositions.

Preparation of the Detergents

The detergents obtainable using the hydroxy mixed ethers according to the invention can be prepared in the form of powders, extrudates, granulates or agglomerates and then transferred to sachets. They may either be universal, or fine or color detergents, optionally in the form of compacts or supercompacts. To prepare such compositions, the corresponding processes known from the prior art are suitable. The compositions are preferably prepared by mixing various particulate components which comprise detergent ingredients together. The particulate components can be prepared by spray drying, simple mixing or complex granulation processes, for example fluidized-bed granulation. Preference is given here in particular to at least one surfactant-containing component being prepared by fluidized-bed granulation. In addition, it may be particularly preferred if aqueous preparations of the alkali metal silicate and the alkali metal carbonate are sprayed together with other detergent ingredients in a drier, it being possible for granulation to take place at the same time as the drying.

Spray-drying

The drier into which the aqueous preparation is sprayed may be any desired drying apparatus. In a preferred procedure, the drying is carried out as spray-drying in a drying tower. In this connection, the aqueous preparations are subjected to a stream of drying gas in finely divided form in a known manner. Patent publications from Henkel describe a variant of spray-drying using superheated steam. The operating principle disclosed therein is thus expressly also part of the present inventive disclosure. Reference is made here in particular to the following publications: DE 4030688 A1 and the continuing publications according to DE 4204035 A1; DE 4204090 A1; DE 4206050 A1; DE 4206521 A1; DE 4206495 A1; DE 4208773 A1; DE 4209432 A1 and DE 4234376 A1. This process has already been presented in connection with the preparation of the defoamer particle.

Fluidized-bed Granulation

A particularly preferred option of preparing the compositions consists in subjecting the preproducts to a fluidized-bed granulation ("SKET" granulation). This is to be understood as meaning a granulation with simultaneous drying, which preferably takes place batchwise or continuously. Here, the preproducts can be used either in the dried state or else as an aqueous preparation. Preferred fluidized-bed apparatuses have base plates with dimensions of from 0.4 to 5 m. The granulation is preferably carried out at fluidized-air speeds in the range from 1 to 8 m/s. The granulates are discharged from the fluidized bed preferably via a size classification of the granulates. Classification can take place, for example, by means of a sieve device or through a countercurrent stream of air (sifter air) which is regulated such that only particles above a certain particle size are removed from the fluidized bed and smaller particles are retained in the fluidized bed. The air which flows in is usually composed of the heated or unheated sifter air and the heated base air. The base air temperature is between 80 and 400° C., preferably 90 and 350° C. Advantageously, at the start of the granulation, a starting mass, for example a granulate from an earlier experimental batch, is initially introduced.

Compression Agglomeration

In another preferred variant, particularly if compositions of high bulk density are to be obtained, the mixtures are then subjected to a compacting step, further ingredients only being added to the compositions after the compacting step. Compaction of the ingredients takes place in a preferred embodiment of the invention in a compression agglomeration process. The compression agglomeration operation to which the solid premix (dried base detergent) is subjected can be realized here in various apparatuses. Depending on the type of agglomerator used, various compression agglomeration processes are differentiated. The four most common and preferred compression agglomeration processes for the purposes of the present invention are extrusion, roll compression or compaction, perforation compression (pelleting) and tableting, meaning that, for the purposes of the present invention, preferred compression agglomeration operations are extrusion, roll compaction, pelleting or tableting operations.

A common feature of all of these processes is that the premix is compressed under pressure and plasticized and the individual particles are pressed together, with a reduction in the porosity, and adhere to one another. In all of the processes the tools can be heated to relatively high temperatures or cooled to dissipate the heat which forms as a result of shear forces.

In all of the processes, one or more binders can be used as auxiliary for the compression. In this connection, however, it should be clarified that the use of two or more different binders and mixtures of different binders is also always possible in itself. In a preferred embodiment of the invention, a binder is used that is already completely in the form of a melt at temperatures up to at most 130° C., preferably up to at most 100° C. and in particular up to 90° C. The binder must thus be chosen depending on the process and process conditions, or the process conditions, in particular the process temperature, have to be adapted—if a certain binder is desired—to the binder.

The actual compression process is preferably carried out at process temperatures which, at least in the compression step, correspond to at least the temperature of the softening point if not indeed the temperature of the melting point of the binder. In a preferred embodiment of the invention, the process temperature is significantly greater than the melting point or greater than the temperature at which the binder is in the form of a melt. In particular, however, it is preferred that the process temperature in the compression step is not more than 20° C. above the melting temperature or the upper limit of the melting range of the binder. Although it is technically entirely possible to establish even higher temperatures, it has, however, been found that a temperature difference relative to the melting temperature or to the softening temperature of the binder of 20° C. is generally entirely adequate and even higher temperatures do not afford any additional advantages. For this reason, it is particularly preferred—in particular also for energetic reasons—to work above, but as close as possible to, the melting point or to the upper temperature limit of the melting range of the binder. Such a temperature control has the added advantage that thermally sensitive raw materials, for example peroxy bleaches, such as perborate and/or percarbonate, and also enzymes, can also be increasingly processed without serious losses of active substance. The possibility of exact temperature control of the binder, in particular in the decisive step of compression, i.e. between mixing/homogenization of the premix and shaping, permits an energetically very favorable process control which is extremely gentle for the temperature-sensitive constituents of the premix since the premix is only exposed to the higher temperatures for a short period. In preferred compression agglomeration processes, the processing tools of the compression agglomerator (the screw(s) of the extruder, the roll(s) of the roll compactor and the compression roll(s) of the pelleting press) have a temperature of at most 150° C., preferably at most 100° C. and in particular at most 75° C., and the process temperature is 30° C. and in particular at most 20° C. above the melting temperature or the upper temperature limit of the melting range of the binder. The duration of the temperature effect in the compression zone of the compression agglomerators is preferably at most 2 minutes and is in particular in a range between 30 seconds and 1 minute.

Preferred binders, which can be used alone or in a mixture with other binders, are polyethylene glycols, 1,2-polypropylene glycols, and modified polyethylene glycols and polypropylene glycols. Modified polyalkylene glycols include, in particular, the sulfates and/or the disulfates of polyethylene glycols or polypropylene glycols with a relative molecular mass between 600 and 12 000 and in particular between 1 000 and 4000. A further group consists of mono- and/or disuccinates of the polyalkylene glycols, which in turn have relative molecular masses between 600 and 6000, preferably between 1000 and 4000. For a more precise description of the modified polyalkylene glycol ethers, reference is made to the disclosure of international patent application WO 93/02176. For the purposes of this invention, polyethylene glycols include those polymers for whose preparation, as well as ethylene glycol, $C_3$–$C_5$-glycols and glycerol and mixtures thereof are likewise used as starting molecules. In addition, ethoxylated derivatives, such as trimethylolpropane having 5 to 30 EO are included. The preferred polyethylene glycols can have a linear or branched structure, preference being given in particular to linear polyethylene glycols. Particularly preferred polyethylene glycols include those with relative molecular masses between 2000 and 12 000, advantageously around 4000, where it is possible to use polyethylene glycols with relative molecular masses below 3500 and above 5000, in particular in combination with polyethylene glycols with a relative molecular mass around 4000, and such combinations advantageously have more than 50% by weight, based on the total amount of polyethylene glycols, of polyethylene glycols with a relative molecular mass between 3500 and 5000. Binders which can be used, however, are also polyethylene glycols which are per se in liquid state at room temperature and a pressure of 1 bar; polyethylene glycol with a relative molecular mass of 200, 400 and 600 is primarily suitable. However, these polyethylene glycols, which are liquid per se, should only be used in a mixture with at least one other binder, this mixture again having to satisfy the requirements according to the invention, i.e. must have a melting point or softening point of at least more than 45° C. Other suitable binders are low molecular weight polyvinylpyrrolidones and derivatives thereof having relative molecular masses up to at most 30 000. Preference is given here to relative molecular mass ranges between 3000 and 30 000, for example around 10 000. Polyvinylpyrrolidones are preferably not used as the sole binder, but in combination with others, in particular in combination with polyethylene glycols. Directly after leaving the preparation apparatus, the compressed material preferably has temperatures not exceeding 90° C., temperatures between 35 and 85° C. being particularly preferred. It has been found that exit temperatures—primarily in the extrusion process—of from 40 to 80° C., for example up to 70° C., are particularly advantageous.

Extrusion

In a preferred embodiment, the detergent according to the invention is prepared by means of extrusion, as described, for example, in European patent EP 0486592 B1 or international patent applications WO 93/02176 and WO 94/09111 and WO 98/12299. In this process, a solid premix is compressed in the form of strands under pressure and, after leaving the perforated die, the strand is cut to the predeterminable granulate dimension by means of a cutting device. The homogeneous and solid premix comprises a plasticizer and/or lubricant, which means that the premix softens plastically and becomes extrudable under the pressure or the input of specific work. Preferred plasticizers and/or lubricants are surfactants and/or polymers. To explain the actual extrusion process, reference is expressly made here to the abovementioned patents and patent applications. Preferably, in this connection, the premix is preferably fed to a planetary roll extruder or a 2-shaft extruder or 2-screw extruder with coacting or counteracting screw control, the housing of which and the extruder granulation head of which can be heated to the predetermined extrusion temperature. Under the shear action of the extruder screws, the premix is compressed under pressure, which is preferably at least 25 bar, but can also be lower in cases of extremely high throughputs and depending on the apparatus used, plasticized, extruded in the form of fine strands through the perforated die plate in the extruder head and finally the extrudate is comminuted using a rotating chopping knife preferably to give approximately spherical to cylindrical granulate particles. The perforation diameter of the perforated die plate and the strand section length are matched to the chosen granulate dimension. Thus, the preparation of granulates of an essentially uniformly predeterminable particle size is possible, it being possible, in individual cases, to match the absolute particle sizes to the intended use purpose. In general, particle diameters up to at most 0.8 cm are preferred. Important embodiments here provide the preparation of uniform granulates in the millimeter range, for example in the range from 0.5 to 5 mm and in particular in the range from about 0.8 to 3 mm. The length/diameter ratio of the chopped primary granulates is here preferably in the range from about 1:1 to about 3:1. It is also preferred to pass the still plastic primary granulate to a further shaping processing step; here, edges present on the crude extrudate are rounded, meaning that ultimately it is possible to obtain spherical to approximately spherical extrudate particles. If desired, small amounts of dry powder, for example zeolite powder, such as zeolite NaA powder, can be co-used in this stage. This shaping can be carried out in commercially available rounding devices. Here, it must be ensured that only small amounts of fines arise in this stage. Drying, which is described in the abovementioned documents of the prior art as a preferred embodiment, is then possible, but not obligatory. It may be preferable not to carry out any more drying after the compaction step. Alternatively, extrusions/compressions can also be carried out in low-pressure extruders, in the Kahl press (Amandus Kahl) or in a Bextruder from Bepex. The temperature is preferably controlled in the transition zone of the screw, of the predistributor and of the die plate in such a way that the melting temperature of the binder or the upper limit of the melting range of the binder is at least reached, but preferably exceeded. In this connection, the duration of the temperature effect in the compression zone of the extrusion is preferably below 2 minutes and in particular in a range between 30 seconds and 1 minute.

Roll Compaction

The detergents according to the invention can also be prepared by means of roll compaction. Here, the premix is fed in in a targeted manner between two smooth rolls or rolls provided with indentations of defined shape, and rolled out between the two rolls under pressure to give a sheetlike compact, the so-called flake. The rolls exert a high linear pressure on the premix and can, if required, additionally be heated or chilled. The use of smooth rolls gives smooth, unstructured flake strands, while the use of structured rolls can produce correspondingly structured flakes in which, for example, certain shapes of the subsequent detergent particles can be preset. The flake strand is then broken into smaller sections by a chopping and communication operation and can be processed in this way to give granulate particles which can be finished by further surface-treatment processes known per se, in particular can be converted to an approximately spherical shape. In the case of roll compaction too, the temperature of the pressing tools, i.e. of the rolls, is preferably at most 150° C., preferably at most 100° C. and in particular at most 75° C. Particularly preferred preparation processes operate in the case of roll compaction at process temperatures which are 10° C., in particular at most 5° C., above the melting temperature or the upper temperature limit of the melting range of the binder. In this connection, it is further preferred that the duration of the temperature effect in the compression zone of the smooth rolls or rolls provided with indentations of defined shape is at most 2 minutes and is in particular in a range between 30 seconds and 1 minute.

Pelleting

The detergent according to the invention can also be prepared by means of pelleting. Here, the premix is applied to a perforated surface and pressed through the holes by means of a pressure-exerting body with plastification. With customary variants of pelleting presses, the premix is compressed under pressure, plasticized, pressed through a perforated surface by means of a rotating roll in the form of fine strands and finally comminuted using a chopping device to give granulate particles. In this connection, a very wide variety of configurations of compression rolls and perforated dies is conceivable. Thus, for example, flat perforated plates are used, as are concave or convex annular dies through which the material is pressed by means of one or more compression rolls. The pressure rolls can also be conical in shape in the case of the plate devices, and in the annular devices, dies and pressure roll(s) can be corotating or counterrotating. An apparatus suitable for carrying out the process is described, for example, in German laid-open specification DE 3816842 A1. The annular die press disclosed in this specification consists of a rotating annular die interspersed by pressure channels, and at least one pressure roll which cooperates with the inside surface of the annular die and which presses the material introduced into the inside of the die through the pressure channels into a material discharge. Here, annular die and pressure roll can be operated in the same direction, as a result of which it is possible to achieve reduced shear stress and therefore a lower temperature increase of the premix. However, it is of course also possible to use heatable or chillable rolls during the pelleting in order to establish a desired temperature of the premix. In the case of pelleting too, the temperature of the compression tools, i.e. of the compression rolls or pressure rolls, is preferably at most 150° C., more preferably at most 100° C. and in particular at most 75° C. Particularly preferred preparation processes operate in the case of roll compaction at process temperatures which are 10° C., in particular at most 5° C., above the melting temperature or the upper temperature limit of the melting range of the binder.

EXAMPLES

Preparation of Surfactant Granulates

Granulate S1 in accordance with the invention. Surfactant granulate consisting of 40% by weight of hydroxy mixed ethers (reaction product of 1,2-epoxydecane with octanol+1PO+22EO), 55% by weight of cellulose and 5% by weight of polycarboxylate, prepared by spray-mixing granulation; sieve fraction between 1.2 mm and 1.6 mm.

Granulate S2 in accordance with the invention. Surfactant granulate consisting of 22% by weight of hydroxy mixed ethers (reaction product of 1,2-epoxydodecane with $C_{13/15}$-oxo alcohol+30EO), 67% by weight of zeolite, auxiliaries and water, prepared by spray-mixing granulation; sieve fraction between 1.2 mm and 1.6 mm.

Granulate S3 in accordance with the invention. Surfactant granulate consisting of 20% by weight of hydroxy mixed ethers (1,2-epoxydodecane with octanol/decanol+12EO) and 70% by weight of zeolite and water, prepared by spray-mixing granulation; sieve fraction between 1.2 mm and 1.6 mm.

Comparison granulate CS1. Surfactant granulate consisting of 22% by weight of $C_{12/18}$-coconut fatty alcohol+7EO, 62% by weight of zeolite A, auxiliaries and water. A sieve fraction between 1.2 mm and 1.6 mm was used.

Comparison granulate CS2. Surfactant granulate consisting of 40% by weight of $C_{12/18}$-coconut fatty alcohol+7EO, 55% by weight of cellulose and water. A sieve fraction between 1.2 mm and 1.6 mm was used.

Performance Investigations

Method A. In each case 40 g of the solid detergent were introduced into a small sack made of polyester fabric (15 cm×15 cm; pore width 120 μm). The small sack was then sealed. In each case 10 of these small sacks were stored, in hermetically packaged form, at 40° C. for 4 weeks. The dissolution rate of the product was then tested by adding one small sack in each case to 1000 ml of water at 30° C. for 2, 5 and 10 min. During this period, a thorough mixing was generated by rotating the sealed vessel. At the end of the test period, the small sack was removed from the solution, briefly dried between two Terry towels and then dried for 16 h at 40° C. To determine the weight of the residue, the small dried sack was weighed and the difference relative to the starting weight was determined.

Method B. In each 40 g of the solid detergent were introduced into a small sack made of hydroxypropylcellulose nonwoven (15 cm×15 cm). The small sack was then sealed. In each case 10 of these small sacks were stored, in hermetically packaged form, at 40° C. for 4 weeks. The dissolution rate of the product was then tested by adding in each case one small sack to 1000 ml of water at 30° C. for 2, 5 and 10 min. During this period, a thorough mixing was generated by rotating the closed vessel. At the end of the test period, the liquor was filtered through a sieve (mesh width: 0.2 mm). The filter residue was dried for 16 h at 40° C. and then weighed.

Method C. In each case 40 g of the solid detergent were introduced into a small sack made of cotton (15 cm×15 cm). The small sack was sealed with polyvinyl-pyrrolidone (PVP) using heat and pressure. In each case 10 of these small sacks were stored, in hermetically packaged form, at 40° C. for 4 weeks. The dissolution rate of the product was then tested by adding in each case one small sack to 1000 ml of water at 30° C. for 2, 5 and 10 min. During this period, a thorough mixing was generated by rotating the closed vessel. At the end of the testing period, the fabric was removed and the liquor was filtered through a sieve (mesh width: 0.2 mm). The filter residue was dried for 16 h at 40° C. and then weighed.

The compositions of the test formulations are summarized in Tables 1A and 1B, the results of the dissolution experiments are given in Table 2.

TABLE 1A

Test formulations - Examples according to the invention (quantitative data as % by weight, water ad 100%)

| Composition | 1 | 2 | 3 | 4 | 5 | 6 | 7 |
|---|---|---|---|---|---|---|---|
| Coconut fatty alcohol sulfate sodium salt[1)] | 6 | 6 | 6 | 6 | 6 | 3 | 3 |
| Dodecylbenzene-sulfonate sodium salt[2)] | 5 | 5 | 5 | 5 | 5 | 5 | 5 |
| Cocoalkyl oligoglucoside[3)] | — | — | — | — | — | 4 | 4 |
| Sodium sulfate | 19 | 19 | 12 | 15 | 15 | 16 | 16 |
| Sodium silicate | 3 | 3 | 3 | 3 | 3 | 3 | 3 |
| Zeolite A | 25 | 25 | 25 | 10 | 8 | — | — |

TABLE 1A-continued

Test formulations - Examples according to the invention (quantitative data as % by weight, water ad 100%)

| Composition | 1 | 2 | 3 | 4 | 5 | 6 | 7 |
|---|---|---|---|---|---|---|---|
| Sodium tripolyphosphate | — | — | — | — | — | 20 | 20 |
| Sodium carbonate | 7 | 7 | 7 | 7 | 7 | 7 | 7 |
| HME-I[4)] | 6 | — | — | — | — | — | — |
| HME-II[5)] | — | 5 | — | — | — | — | — |
| Surfactant granulate S1 | — | — | 12 | — | — | 12 | — |
| Surfactant granulate S2 | — | — | — | 23 | — | — | 23 |
| Surfactant granulate S3 | — | — | — | — | 25 | — | — |
| Sodium percarbonate | 12 | 12 | 12 | 12 | 12 | 12 | 12 |
| Polycarboxylate[6)] | 4 | 4 | 4 | 4 | 4 | 4 | 4 |
| TAED | 4 | 4 | 4 | 4 | 4 | 4 | 4 |
| Defoamer | 4 | 4 | 4 | 4 | 4 | 4 | 4 |

[1)]Sulfopon ® 1218 G (Cognis Deutschland GmbH, anionic surfactant content 95% by weight)

[2)]Maranil ® 2G (Cognis Deutschland GmbH, anionic surfactant content 75% by weight)

[3)]Glucopon ® 50 G (Cognis Deutschland GmbH, nonionic surfactant content 50% by weight)

[4)]Reaction product of 1,2-epoxydecane and octanol + 1PO + 22EO

[5)]Reaction product of 1,2-epoxydodecane with $C_{13/15}$-oxo fatty alcohol + 30EO)

[6)]Sokalan ® CP 5 (Cognis Deutschland GmbH)

TABLE 1B

Test formulations - comparative examples (quantitative data as % by weight, water ad 100%)

| Composition | C1 | C2 | C3 | C4 |
|---|---|---|---|---|
| Coconut fatty alcohol sulfate sodium salt | 6 | 6 | 6 | 3 |
| Dodecylbenzenesulfonate sodium salt | 5 | 5 | 5 | 5 |
| Cocoalkyl oligoglucoside | — | — | — | 4 |
| Sodium sulfate | 20 | 15 | 15 | 20 |
| Sodium silicate | 3 | 3 | 3 | 3 |
| Zeolite A | 25 | 10 | 25 | — |
| Sodium tripolyphosphate | — | — | — | 20 |
| Sodium carbonate | 7 | 7 | 7 | — |
| $C_{12/18}$-coconut fatty alcohol + 7EO | 5 | — | — | — |
| Surfactant granulate CS1 | — | 23 | — | — |
| Surfactant granulate CS2 | — | — | 8 | 8 |
| Sodium percarbonate | 12 | 12 | 12 | 12 |
| Polycarboxylate | 4 | 4 | 4 | 4 |
| TAED | 4 | 4 | 4 | 4 |
| Defoamer | 4 | 4 | 4 | 4 |

TABLE 2

| | | Dissolution rates | | | | | | | | | | |
|---|---|---|---|---|---|---|---|---|---|---|---|---|
| | Time | Amount of residue [g] | | | | | | | | | | |
| Type | [min] | 1 | 2 | 3 | 4 | 5 | 6 | 7 | C1 | C2 | C3 | C4 |
| A | 2 | 34 | 36 | 30 | 35 | 32 | — | — | 39 | 38 | 35 | — |
| | 5 | 25 | 28 | 15 | 20 | 18 | — | — | 33 | 28 | 25 | — |
| | 10 | 8 | 10 | 0 | 5 | 1 | — | — | 20 | 15 | 15 | — |
| B | 2 | 30 | 31 | 25 | 28 | 22 | 16 | 20 | 35 | 35 | 30 | 25 |
| | 5 | 12 | 10 | 3 | 8 | 4 | 0 | 4 | 18 | 15 | 10 | 10 |
| | 10 | 0 | 0 | 0 | 0 | 0 | 0 | 0 | 2 | 5 | 3 | 3 |
| C | 2 | 32 | 32 | 23 | 26 | 20 | 14 | 19 | 32 | 34 | 28 | 23 |
| | 5 | 12 | 10 | 3 | 7 | 5 | 0 | 4 | 15 | 15 | 13 | 10 |
| | 10 | 0 | 0 | 0 | 0 | 0 | 0 | 0 | 2 | 4 | 2 | 2 |

What is claimed is:

1. A cleaning packet comprising a water-soluble container or a water-insoluble container comprising a compound of the formula (I)

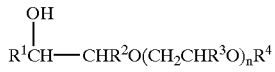

(I)

wherein $R^1$ is a linear or branched alkyl radical having from 2 to 18 carbon atoms, $R^2$ is hydrogen or a linear or branched alkyl radical having from 2 to 18 carbon atoms, $R^3$ is hydrogen or methyl, $R^4$ is a linear or branched, alkyl and/or alkenyl radical having from 1 to 22 carbon atoms and n is a number from 1 to 50, with the proviso that the sum of the carbon atoms in the radicals $R^1$ and $R^2$ is at least 6.

2. The packet of claim 1 wherein the amount of compound of formula (I) is from 0.2 to 20% by weight of the packet.

3. The packet of claim 2 wherein the amount of compound of formula (I) is from 0.2 to 10% by weight of the packet.

4. The packet of claim 3 wherein the amount of compound of formula (I) is from 0.2 to 5% by weight of the packet.

5. The packet of claim 1 wherein the compound of formula (I) is the reaction product of 1,2-epoxy-decane and octanol alkoxylated with one mole of propylene oxide and 22 moles of ethylene oxide.

6. The packet of claim 1 wherein the compound of formula (I) is the reaction product of 1,2-epoxy-dodecane and $C_{13/15}$oxo alcohol alkoxylated with 30 moles of ethylene oxide.

7. The packet of claim 1 wherein the compound of formula (I) is the reaction product of 1,2-epoxy-dodecane and octanol/decanol alkoxylated with 12 moles of ethylene oxide.

* * * * *